US011760592B2

(12) United States Patent
Asada et al.

(10) Patent No.: US 11,760,592 B2
(45) Date of Patent: Sep. 19, 2023

(54) SHEET FEEDING DEVICE INCLUDING A PLURALITY OF SEPARATION PIECES MOVABLE TO SEPARATE UPPERMOST SHEET FROM STACK OF SHEETS

(71) Applicant: BROTHER KOGYO KABUSHIKI KAISHA, Nagoya (JP)

(72) Inventors: Tetsuo Asada, Kuwana (JP); Tadanobu Chikamoto, Nagoya (JP); Gakuro Kanazawa, Toyokawa (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/340,299

(22) Filed: Jun. 7, 2021

(65) Prior Publication Data

US 2021/0395028 A1 Dec. 23, 2021

(30) Foreign Application Priority Data

Jun. 19, 2020 (JP) ..... 2020-106274
Jun. 19, 2020 (JP) ..... 2020-106275

(51) Int. Cl.
*B65H 3/52* (2006.01)

(52) U.S. Cl.
CPC ..... *B65H 3/5215* (2013.01); *B65H 2401/11* (2013.01); *B65H 2405/1136* (2013.01); *B65H 2405/141* (2013.01); *B65H 2405/1412* (2013.01)

(58) Field of Classification Search
CPC ..... B65H 1/04; B65H 3/06; B65H 3/0684; B65H 3/5207; B65H 3/5215;
(Continued)

(56) References Cited

U.S. PATENT DOCUMENTS

2003/0132570 A1* 7/2003 Park ..... B65H 1/04 271/167
2006/0180992 A1 8/2006 Asada
(Continued)

FOREIGN PATENT DOCUMENTS

JP 2006-182481 A 7/2006
JP 2008-230845 A 10/2008
JP 2011-073826 A 4/2011

*Primary Examiner* — Prasad V Gokhale
(74) *Attorney, Agent, or Firm* — Scully, Scott, Murphy & Presser, P.C.

(57) ABSTRACT

A sheet feeding device includes: an accommodating unit having a placement surface on which the stack of sheets is mounted; an inclined member having an inclined surface inclined relative to the placement surface to extend in an inclined direction and a back surface opposite the inclined surface; a sheet pick-up unit for feeding an uppermost sheet in the stack of sheets toward the inclined member; and a sheet separating member provided on the inclined surface. The sheet separating member includes a plurality of separation pieces and a support portion those made of resin. The support portion supports the separation pieces at positions closer to the back surface than to the inclined surface so that the separation pieces are movable away from the placement surface in the inclined direction and toward the back surface in a normal direction of the inclined surface independently from one another.

21 Claims, 15 Drawing Sheets

(58) Field of Classification Search
CPC ..... B65H 3/5223; B65H 2401/115; B65H 2405/113; B65H 2405/1136; B65H 2405/141; B65H 2405/1412; B65H 2401/11
See application file for complete search history.

(56) References Cited

U.S. PATENT DOCUMENTS

| | | | | |
|---|---|---|---|---|
| 2008/0230979 | A1* | 9/2008 | Asada | B65H 3/0684 271/121 |
| 2009/0026693 | A1* | 1/2009 | Lim | B65H 3/0684 271/121 |
| 2009/0243184 | A1* | 10/2009 | Asada | B65H 3/56 271/3.14 |
| 2011/0074093 | A1 | 3/2011 | Asada et al. | |
| 2011/0180986 | A1* | 7/2011 | Okawa | B65H 3/56 271/127 |

* cited by examiner

SHEET FEEDING DEVICE INCLUDING A PLURALITY OF SEPARATION PIECES MOVABLE TO SEPARATE UPPERMOST SHEET FROM STACK OF SHEETS

CROSS REFERENCE TO RELATED APPLICATION

This application claims priorities from Japanese Patent Application Nos. 2020-106274 filed Jun. 19, 2020 and 2020-106275 filed Jun. 19, 2020. The entire contents of the priority applications are incorporated herein by reference.

TECHNICAL FIELD

The present disclosure relates to a sheet feeding device for feeding a sheet one by one by picking up the sheet from a stack of sheets.

BACKGROUND

A conventional image recording apparatus such as a printer including a sheet feeding device and an image recording unit is known in the art. The sheet feeding device is configured to feed an image recording medium such as a sheet to the image recording unit such as an inkjet head or a photosensitive drum. The sheet feeding device includes a sheet accommodating unit for accommodating therein a stack of sheets in which a plurality of sheets are superimposed, an inclined member positioned between the sheet accommodating unit and the image recording unit, and a sheet feeding unit such as a pick-up roller for feeding a sheet from the sheet accommodating unit to the inclined member. The inclined member is generally a member having a plate like shape made from resin, and has an inclined surface inclined relative to a sheet placement surface of the sheet accommodating unit on which the stack of sheets is mounted.

In the conventional sheet feeding device, the sheet feeding unit is brought into contact with an uppermost sheet of the stack of sheets so that the sheets of the stack of sheets are fed to the inclined member one by one. In order to avoid feeding of multiple sheets in one time, the sheet feeding device is further provided with a sheet separating member disposed on the inclined surface of the inclined member for separating a leading edge of the sheet from the stack of sheets.

For example, Japanese Patent Application Publication No. 2006-182481 discloses a sheet feeding device provided with an inclined member and a sheet separating member including a plurality of separation pieces made from metal. The separation pieces are arranged in a sheet feeding direction to be separated from one another with a prescribed interval. Further, Japanese Patent Application Publication No. 2011-073826 discloses a sheet feeding device provided with a sheet separating member and an inclined member. The sheet separating member includes a plurality of separation pieces made from resin and provided integrally with the inclined member. In the sheet separating member in Japanese Patent Application Publication No. 2011-073826, each of the separation pieces protrudes from an inclined surface of the inclined member toward a sheet placement surface of a sheet accommodating unit while extending toward a downstream side in a sheet feeding direction.

SUMMARY

The sheet separating member described in Japanese Patent Application Publication No. 2006-182481 can be provided, for example, as a metallic member in which a plurality of separation pieces are integrally formed by punching a metallic sheet. Since such separation pieces made from metal can exhibit sufficient resilient deformation, these separation pieces can suitably perform separating of the leading edge of the uppermost sheet from the stack of sheets. However, since the inclined member on which the sheet separating member is mounted is made from resin, the separating member and the inclined member cannot be integrally provided with each other. Therefore, the number of parts required for the sheet feeding device is increased, and the inclined member made from resin and the sheet separating member made from metal must be separated from each other when recycled, which may lead to lowering of adaptability for recycling.

Further, according to the sheet separating member described in Japanese Patent Application Publication No. 2011-073826, the sheet separating member can be integrally molded with the inclined member since both the sheet separating member and the inclined member are made from resin. Even if the sheet separating member is formed separately from the inclined member, lowering of adaptability for recycling can be suppressed as the sheet separating member and the inclined member are made from resin of identical material. However, since each of the separation pieces extends toward downstream side in the sheet supplying direction, sufficient resilient urging force may not be generated in the separation pieces depending on kind of resin, and hence, efficient separating of the leading edge of the sheet from the stack of sheets may not be performed.

In view of the foregoing, it is an object of the present disclosure to provide a sheet feeding device including a sheet separating member provided with separation pieces which is made from resin and is capable of generating sufficient resilient urging force in order to suitably perform separating of a leading edge of an uppermost sheet from a stack of sheets.

In order to attain the above and other object, according to one aspect, the present disclosure provides a sheet feeding device including: an accommodating unit for accommodating therein a stack of a plurality of sheets; an inclined member; a sheet pick-up unit for feeding an uppermost sheet in the stack of a plurality of sheets on the placement surface toward the inclined member; and a sheet separating member. The accommodating unit has a placement surface on which the stack of a plurality of sheets is to be mounted. The inclined member has an inclined surface and a back surface opposite the inclined surface. The inclined surface is inclined relative to the placement surface to extend in an inclined direction. The sheet separating member is provided on the inclined surface. The sheet separating member includes: a plurality of separation pieces; and a support portion. Each of the plurality of separation pieces is made of resin and has a distal end protruding from the inclined surface and a base end. The support portion is made of resin and supports the base end of each of the plurality of separation pieces at a position closer to the back surface than to the inclined surface. The plurality of separation pieces are supported by the support portion so that the plurality of separation pieces are movable in a direction away from the placement surface in the inclined direction and in a direction toward the back surface in a normal direction of the inclined surface independently from one another.

According to another aspect, the present disclosure also provides a sheet feeding device including: an accommodating unit for accommodating therein a stack of a plurality of sheets; an inclined member; a sheet pick-up unit for feeding an uppermost sheet in the stack of a plurality of sheets on the placement surface toward the inclined member; and a sheet separating member. The accommodating unit has a placement surface on which the stack of a plurality of sheets is to be mounted. The inclined member has an inclined surface and a back surface opposite the inclined surface. The inclined surface is inclined relative to the placement surface to extend in an inclined direction. The sheet separating member is provided on the inclined surface. The sheet separating member includes: a plurality of separation pieces; and at least one support portion. Each of the plurality of separation pieces is made of resin and has a distal end protruding from the inclined surface and a base end. The at least one support portion is made of resin and supports the base end of each of the plurality of separation pieces at a position closer to the back surface than to the inclined surface. The inclined surface is formed with a plurality of openings arranged in a widthwise direction perpendicular to the inclined direction, each of the plurality of openings allowing at least one of the plurality of separation pieces to protrude therethrough. The at least one support portion is connected to portions of the inclined member defining both edges in the widthwise direction of each of the plurality of openings at the back surface so that the at least one support portion is bridged over each of the plurality of openings in the widthwise direction.

BRIEF DESCRIPTION OF THE DRAWINGS

The particular features and advantages of the embodiment(s) as well as other objects will become apparent from the following description taken in connection with the accompanying drawings, in which.

DETAILED DESCRIPTION

Figure 1:
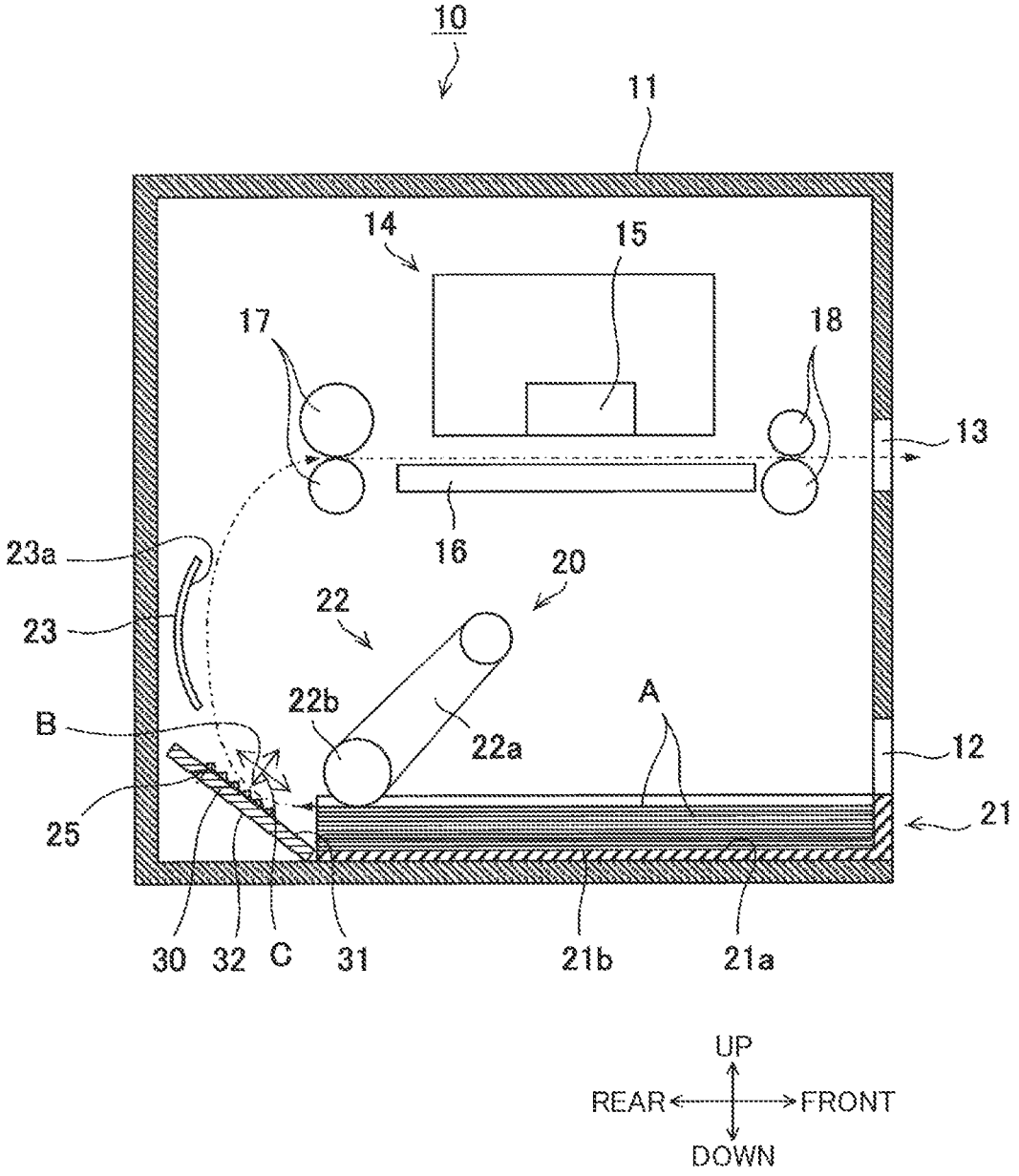
FIG. 1 is a schematic diagram of an image recording apparatus including a sheet feeding device according to a first embodiment of the present disclosure.

Hereinafter, embodiments of the present disclosure will be described while referring to the accompanying drawings, wherein like parts and components are designated by the same reference numerals to avoid duplicating description.

1. First Embodiment

[Overall Configuration of Image Forming Apparatus]

As illustrated in FIG. 1, an image recording apparatus 10 includes a housing 11, a recording unit 14, and a sheet feeding device 20 according to a first embodiment. The image recording apparatus 10 is configured to feed sheets A by the sheet feeding device 20 toward the recording unit 14 and to record images on the sheets A by the recording unit 14. In the following description, an inkjet printer is described as an example of the image recording apparatus 10, and sheets of paper is described as an example of the sheets A. However, the image recording apparatus 10 and the sheet A are not limited to these examples.

Incidentally, a direction directed from the sheet feeding device 20 to the recording unit 14 will be defined as an upward direction, and a direction opposite thereto will be defined as a downward direction. The upward direction and the downward direction will be collectively referred to as an up-down direction. Further, directions perpendicular to the up-down direction will be defined as a leftward direction and a rightward direction (collectively referred to as a left-right direction) and a frontward direction and a rearward direction (collectively referred to as a front-rear direction). The left-right direction and the front-rear direction are perpendicular to each other. Note that arrangement of components in the image recording apparatus 10 is not limited to this configuration.

The housing 11 defines therein an internal space in which the recording unit 14 and the sheet feeding device 20 are accommodated. The housing 11 has a front surface and a rear surface. An insertion opening 12 and a discharge opening 13 are open on the front surface. The insertion opening 12 is formed at a position downward of the discharge opening 13.

The internal space of the housing 11 is in communication with an outside through the insertion opening 12 and the discharge opening 13.

The recording unit 14 includes a recording head 15, a platen 16, and a conveying unit. The recording head 15 includes a plurality of driving elements and a plurality of nozzles allowing liquid such as ink to be ejected therethrough, and has an ejection surface where the nozzles are open. The driving elements are constituted by piezoelectric elements, and are provided in one-to-one correspondence to the nozzles. Each of the driving elements is configured to apply pressure to liquid so that liquid is ejected through the corresponding one of nozzles. The nozzles are arranged, for example, in the left-right direction to constitute a nozzle array.

The recording head 15 may employ a line head system or a serial head system. In a case where the recording head 15 is of a line head system, the nozzle array has a length in the left-right direction greater than that of the sheet A. In a case where the recording head 15 employs a serial head system instead, the recording head 15 is mounted on a carriage, and is reciprocally movable in the left-right direction by the reciprocating movement of the carriage.

The platen 16 has a flat upper surface at a position downward of the recording head 15 and upward of the sheet feeding device 20. The upper surface faces and is spaced apart from the ejection surface in the up-down direction. The upper surface is a surface on which the sheet A is mounted when an image is to be recorded thereon.

The conveying unit includes a pair of upstream rollers 17 and a pair of downstream rollers 18. The pair of upstream rollers 17 have rotation axes extending in the left-right direction, and provided to arrange in the up-down direction to nip the sheet A in cooperation with each other at a position rearward of the platen 16, i.e., positioned at an upstream side of the platen 16 in a sheet conveying direction. One roller of the pair of upstream rollers 17 is a drive roller rotatable by a driving force from a motor (not illustrated). Rotation of the drive roller causes rotation of the driven roller (the remaining one roller of the upstream rollers 17) so that these rollers convey the sheet A frontward.

The downstream rollers 18 are positioned frontward of the platen 16, i.e., positioned at a downstream side of the platen 16 in the sheet conveying direction, and have rotation axes extending in the left-right direction. The downstream rollers 18 are arranged in the up-down direction to nip the sheet A in cooperation with each other. One roller of the pair of downstream rollers 18 is a drive roller rotatable by the driving force from the motor. Rotation of the drive roller causes rotation of the driven roller (the remaining one roller of the downstream rollers 18) to convey the sheet A frontward.

The sheet feeding device 20 includes a sheet accommodating unit 21, an inclined member 30, a sheet pick-up unit 22, a guide member 23, and a sheet separating member 25. The sheet accommodating unit 21 is a tray in a form of a box including a bottom plate 21*b* and having an upper open end, and is configured to accommodate therein a stack of a plurality of sheets A. The bottom plate 21*b* has an upper surface functioning as a sheet placement surface 21*a* on which the stack of sheets can be mounted.

The sheet accommodating unit 21 can be inserted into the housing 11 through the insertion opening 12, and is positioned below the sheet pick-up unit 22 when inserted into the housing 11. Incidentally, the sheet accommodating unit 21 may not be entirely positioned within the housing 11. For example, a rear portion of the sheet accommodating unit 21 may be positioned in the housing 11 while a front portion of the sheet accommodating unit 21 is positioned outside of the housing 11.

The sheet pick-up unit 22 is configured to pick up an uppermost sheet A in the stack of sheets to feed the uppermost sheet A toward the inclined member 30. The sheet pick-up unit 22 includes an arm 22*a* and at least one pick-up roller 22*b*. The arm 22*a* is inclined relative to the front-rear direction so that one end portion thereof is positioned frontward of another end portion thereof. The one end portion of the arm 22*a* is supported by the housing 11 so that the arm 22*a* is pivotally movable about a pivot axis extending in the first direction. Due to pivotal movement of the arm 22*a*, an angle of inclination of the arm 22*a* can be changed.

The pick-up roller 22*b* is supported by the other end portion of the arm 22*a* and is rotatable about a rotation axis extending in the left-right direction. In a case where a plurality of pick-up rollers 22*b* are provided, these pick-up rollers 22*b* are coupled to the other end portion of the arm 22*a* to be coaxially arranged in the left-right direction.

The pick-up roller 22*b* is positioned above the sheet accommodating unit 21, and at a center portion of the sheet accommodating unit 21 in the left-right direction. The pick-up roller 22*b* makes contact the uppermost sheet A of the stack of sheets A mounted on the sheet placement surface 21*a*. A distance between the uppermost sheet A and the sheet placement surface 21*a* in the up-down direction varies depending on the number of sheets placed on the sheet placement surface 21*a*. Inclination angle of the arm 22*a* changes in response to the variation in the distance between the uppermost sheet A and the sheet placement surface 21*a*, so that the pick-up roller 22*b* is movable in up-down direction to maintain contact with the uppermost sheet A. The pick-up roller 22*b* is rotatable by a driving force from the motor to convey the sheet A in the sheet conveying direction (rearward).

The inclined member 30 is made of resin, and has a plate-like portion. The inclined member 30 is positioned rearward of the sheet accommodating unit 21 and the pick-up roller 22*b*. The flat plate-like portion is positioned to be aligned with the center portion of the sheet accommodating unit 21 in the left-right direction. The flat plate-like portion has a front surface serving as an inclined surface 31, and a rear surface opposite thereto serving as a back surface 32.

The inclined surface 31 is a flat surface, and is inclined at a constant angle relative to the sheet placement surface 21*a* such that the inclined surface 31 extends rearward as going upward. The inclined surface 31 faces a leading edge (a rear edge) of the sheet(s) A mounted on the sheet placement surface 21*a*. The inclined surface 31 has an upper end and a lower end, and the lower end is positioned closer to the sheet placement surface 21*a* than the upper end is to the sheet placement surface 21*a* in the up-down direction and the front-rear direction. Incidentally, the inclined surface 31 may have a curved shape extending rearward and upward, and a center portion in the left-right direction of the inclined surface 31 is positioned frontward than a remaining portion of the inclined surface 31.

Figure 2:
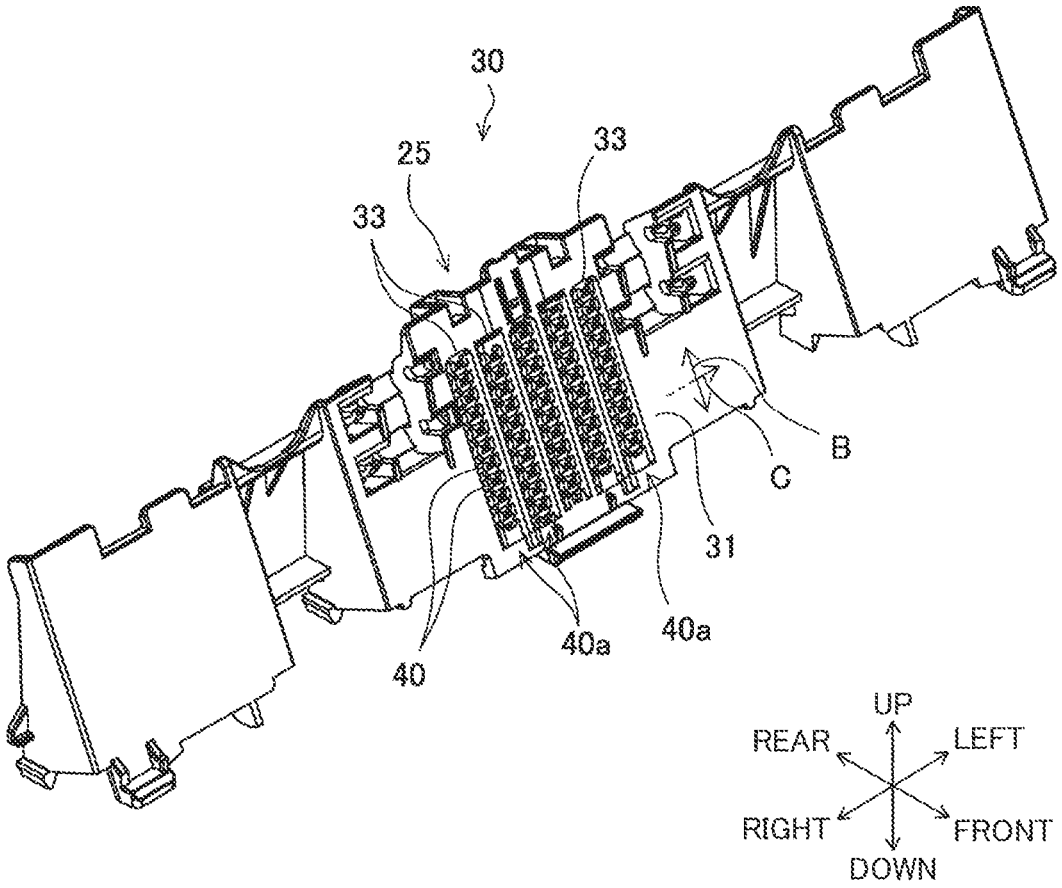
FIG. 2 is a perspective view of an inclined member and a sheet separating member in the sheet feeding device according to the first embodiment.

In the following direction, a direction parallel to the inclined surface 31 and perpendicular to the left-right direction will be referred to as "inclined direction". The inclined direction extends diagonally upward and rearward, and diagonally downward and frontward as indicated by an arrow B in FIGS. 2 and 3. The inclined direction B defines an inclination angle relative to the sheet placement surface 21*a*. In the inclined direction B, the inclined surface 31 extends diagonally upward and rearward from a rear end of the sheet placement surface 21*a*. A side close to the sheet placement surface 21*a* will be referred to as "upward" in the inclined direction B, and a side opposite thereto will be referred to as "downward" in the inclined direction B. Also, the inclined direction B corresponds to a moving direction of a sheet A moving past the inclined surface 31. The side close to the sheet placement surface 21*a* corresponds to an upstream side in the moving direction, and the side opposite thereto corresponds to a downstream side in the moving direction.

Further, a direction parallel to the inclined surface 31 and perpendicular to the inclined direction B is defined as "widthwise direction". The widthwise direction corresponds to the left-right direction. The widthwise direction is also a direction in which an imaginary line where the inclined surface 31 and an imaginary surface obtained by extending the sheet placement surface 21*a* cross each other extends. Still further, a normal direction of the inclined surface 31 is a direction perpendicular to the inclined direction B, as indicated by an arrow C. A side close to the back surface 32 will be referred to as "rear side", while the side opposite thereto will be referred to as "front side" in the normal direction C.

The guide member 23 is positioned above the inclined member 30 and rearward of the conveying unit, and has a front surface serving as a curved surface 23*a*. The curved surface 23*a* extends linearly in the left-right direction, and is curved to be recessed rearward. That is, the curved surface 23*a* has a center portion in the up-down direction positioned further rearward than the remaining portion of the curved surface 23*a*. The guide member 23 and the inclined member 30 constitute a U-turn passage for guiding the sheet A fed from the sheet accommodating unit 21 by the rotation of the pick-up roller 22*b* toward the recording unit 14.

The sheet separating member 25 is provided on the inclined surface 31 of the inclined member 30, and is configured to separate a sheet A from the stack of the sheets A. The sheet separating member 25 is positioned rearward of the pick-up roller 22*b* such that the sheet separating member 25 is in alignment with the pick-up roller 22*b* as viewed from the front side toward the rear side. The sheet separating member 25 may have a width in the left-right direction greater than that of the pick-up roller 22*b*. Details of the sheet separating member 25 will be described later.

[Operation in Image Recording Apparatus]

In the image recording apparatus 10, the sheet accommodating unit 21 is positioned inside the housing 11 while the stack of sheets A is mounted on the sheet placement surface 21*a*, and the pick-up roller 22*b* is in contact with the uppermost sheet A of the stack of sheets A. Upon rotation of the pick-up roller 22*b* in response to print instruction having been inputted, the uppermost sheet A in the stack of sheets A is fed rearward, and is moved onto the inclined member 30, and is moved along the inclined surface 31 diagonally upward and rearward (i.e., upward in the inclined direction B).

Here, there is a likelihood that one or more sheets A positioned below the uppermost sheet A be moved along with the movement of the uppermost sheet A. In this case, the uppermost sheet A is separated from the remaining sheet(s) A by the sheet separating member 25, and is moved along the inclined surface 31 to the guide member 23.

The sheet A is moved rearward and then frontward along the curved surface 23*a* of the guide member 23. Then, the sheet A is nipped between the pair of upstream rollers 17 and is conveyed frontward to the platen 16 by the rotation of the pair of upstream rollers 17. While the sheet A is placed on the upper surface of the platen 16, liquid is ejected on the sheet A from the ejection surface of the recording unit 14 to form an image on the sheet A. The sheet A is nipped between the pair of downstream rollers 18 and is conveyed frontward by the rotation of the pair of downstream rollers 18. The sheet A is then discharged outside the housing 11 through the discharge opening 13.

[Configuration of Sheet Separating Member]

As illustrated in FIGS. 2 through 6, the sheet separating member 25 includes a plurality of separation pieces 40 and a support portion 50, those being made of resin. A plurality of slits 33 (five slits 33 in the present embodiment) are open on the inclined surface 31. Each of the slits 33 has an elongated rectangular shape extending in the inclined direction B. The slits 33 extend parallel to each other and arranged to be spaced apart from each other in the left-right direction.

The plurality of separation pieces 40 are arranged in parallel to be spaced apart from each other in the inclined direction B to constitute a separation piece array 40*a*. A plurality of (five in the embodiment) separation piece arrays 40*a* are arranged to be juxtaposed with each other in the left-right direction. The plurality of separation piece arrays 40*a* are provided in the plurality of slits 33 in one-to-one correspondence.

Figure 5:
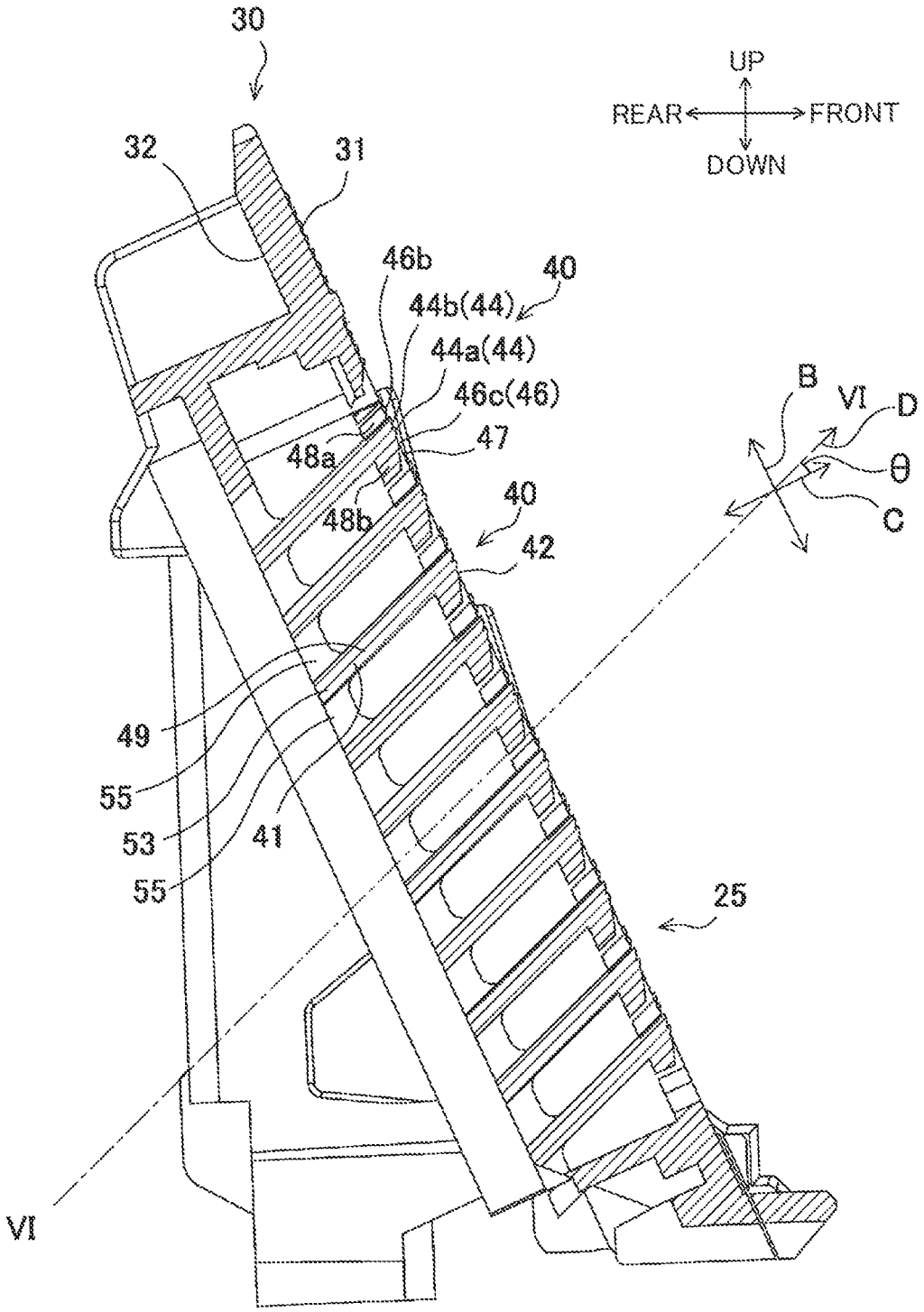
FIG. 5 is a cross-sectional view of the inclined member and the sheet separating member those illustrated in FIG. 2 taken along a plane perpendicular to a left-right direction.

As illustrated in FIG. 5, each of the separation pieces 40 has a generally plate-like shape that has a cross-section of rectangular shape. Further, each of the separation pieces 40 has a base end 41 and a distal end 42. The separation piece 40 linearly extends diagonally upward and frontward in an extending direction indicated by an arrow D in FIG. 5 from the base end 41 thereof to the distal end 42 thereof. The separation piece 40 has a dimension in a direction perpendicular to the extending direction D and the left-right direction smaller than a dimension in the extending direction D thereof and a dimension in the left-right direction thereof. Further, the dimension in the left-right direction of the separation piece 40 is smaller than the dimension in the extending direction D.

The distal end 42 of each of the separation pieces 40 is positioned further frontward than the inclined surface 31, and the base end 41 of each of the separation pieces 40 is positioned further rearward than both the inclined surface 31 and the back surface 32. Further, an inclination angle defined between the extending direction D relative to the sheet placement surface 21*a* may be greater than an angle defined between the normal direction C and the sheet placement surface 21*a*. In this case, the smaller (acute) angle θ defined between the extending direction D and the normal direction C is less than 45 degrees.

Figure 4:
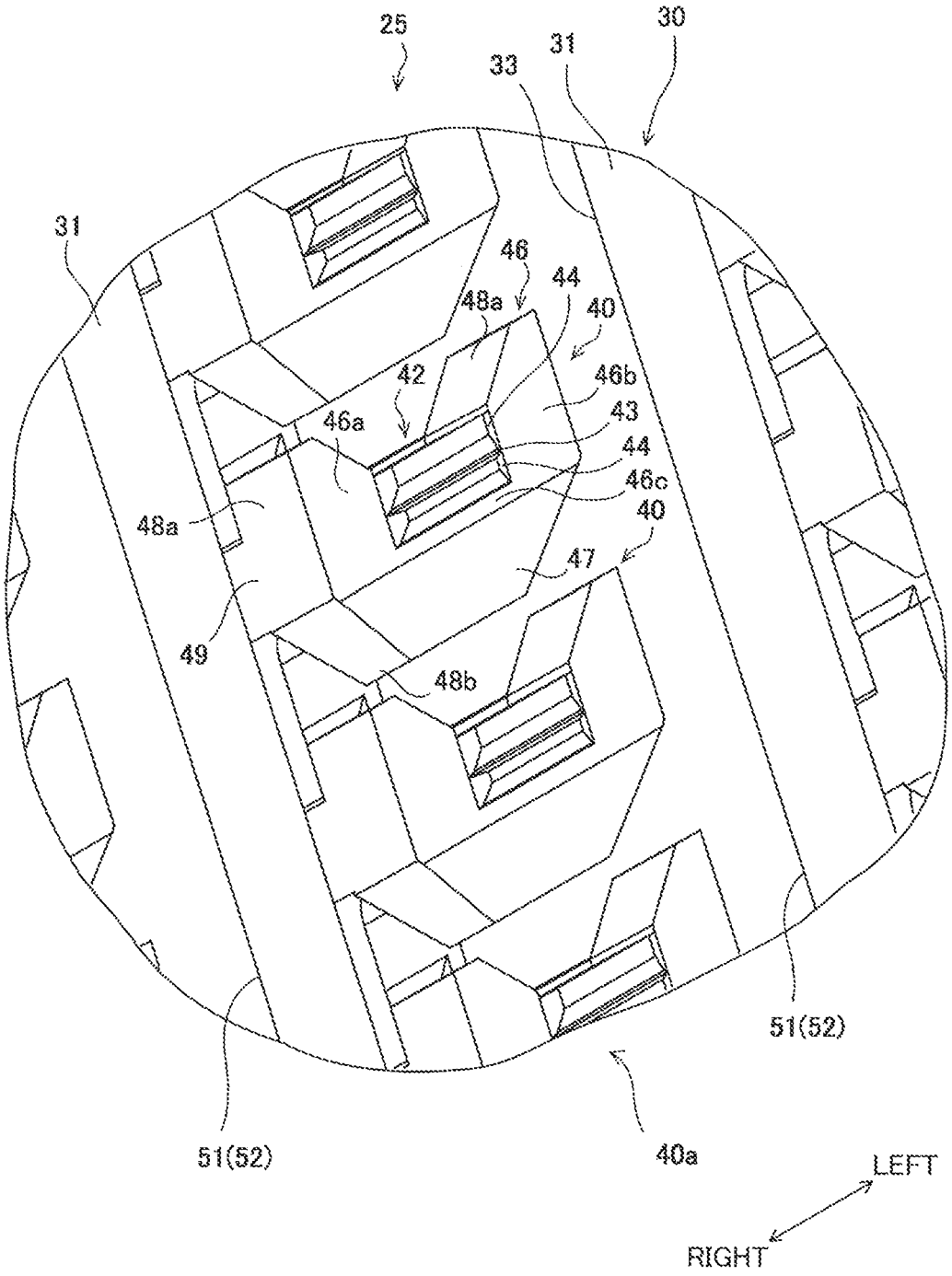
FIG. 4 is a partial enlarged perspective view of the inclined member and the sheet separating member those illustrated in FIG. 2 in the sheet feeding device according to the first embodiment.

As illustrated in FIG. 4, the distal end 42 of the separation piece 40 is formed with a single slit portion 43. The slit portion 43 is recessed rearward from the distal end 42 and extends in the left-right direction. The slit portion 43 separates the distal end 42 into two protrusions 44. The two protrusions 44 have shapes substantially identical to each other, and are arranged in line with each other in the inclined direction B. The protrusions 44 extend linearly in the left-right direction, and are inclined such that a length of the separation piece 40 in the extending direction D is gradually decreased as extending frontward and downward.

Figure 6:
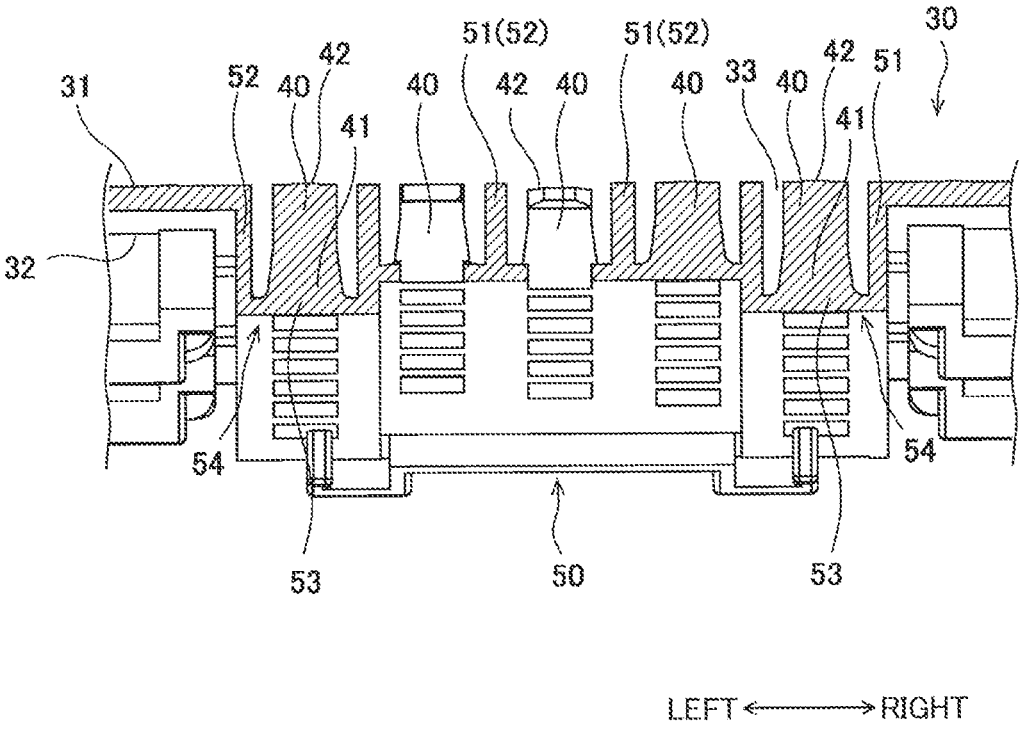
FIG. 6 is a cross-sectional view of the inclined member and the sheet separating member in the sheet feeding device according to the first embodiment taken along a line VI-VI in FIG. 5.

As illustrated in FIG. 6, the support portion 50 is positioned further rearward than the back surface 32. The support portion 50 includes a pair of side walls (a right wall 51 and a left wall 52) and a bottom wall 53 that constitutes a substantially U-shape for each of the plurality of separation piece arrays 40*a*. These walls 51, 52 and 53 have flat plate-like shape, for example, and are integrally formed with each other.

Each of the right walls 51 and the left walls 52 has a front end connected to the back surface 32 of the inclined member 30. The right wall 51 and the left wall 52 elect rearward in the normal direction C from the back surface 32 in parallel to each other. Each of the right walls 51 extends in the inclined direction B along a right edge of a corresponding one of the slits 33, and each of the left walls 52 extends in the inclined direction B along a left edge of the corresponding one of the slits 33. In the two neighboring slits 33 in the left-right direction, the left wall 52 for the right slit 33 and the right wall 51 for the left slit 33 are formed integrally with each other. However, these right wall 51 and left wall 52 between two neighboring slits 33 may be provided independently from each other.

Each of the bottom walls 53 extends in the inclined direction B. Each of the bottom walls 53 has a right end connected to a rear end of the right wall 51 for the corresponding slit 33, and a left end connected to a rear end of the left wall 52 for the corresponding slit 33. That is, each of the bottom walls 53 spans between the corresponding one of the right walls 51 and left walls 52. That is, the support portion 50 is connected to portions of the back surface 32 defining the right and left edges of each of the slits 33 such that the support portion 50 is bridged over each of the slit 33 in the left-right direction. In other words, the right wall 51 and the left wall 52 are connected to the portion of the back surface 32 positioned between the two neighboring slits 33.

Further, each of the bottom walls 53 has a front surface extending perpendicular to the normal direction C and faces the corresponding one of the slits 33. That is, each of the slits 33 is surrounded by the corresponding right wall 51, the left wall 52, and the bottom wall 53. The right wall 51, the left wall 52, and the bottom wall 53 for each of the slits 33 constitute a groove portion 54 recessed rearward from the inclined surface 31 of the inclined member 30. A front surface of each of the bottom wall 53 serves as a bottom surface of the corresponding one of the groove portions 54.

Figure 3:
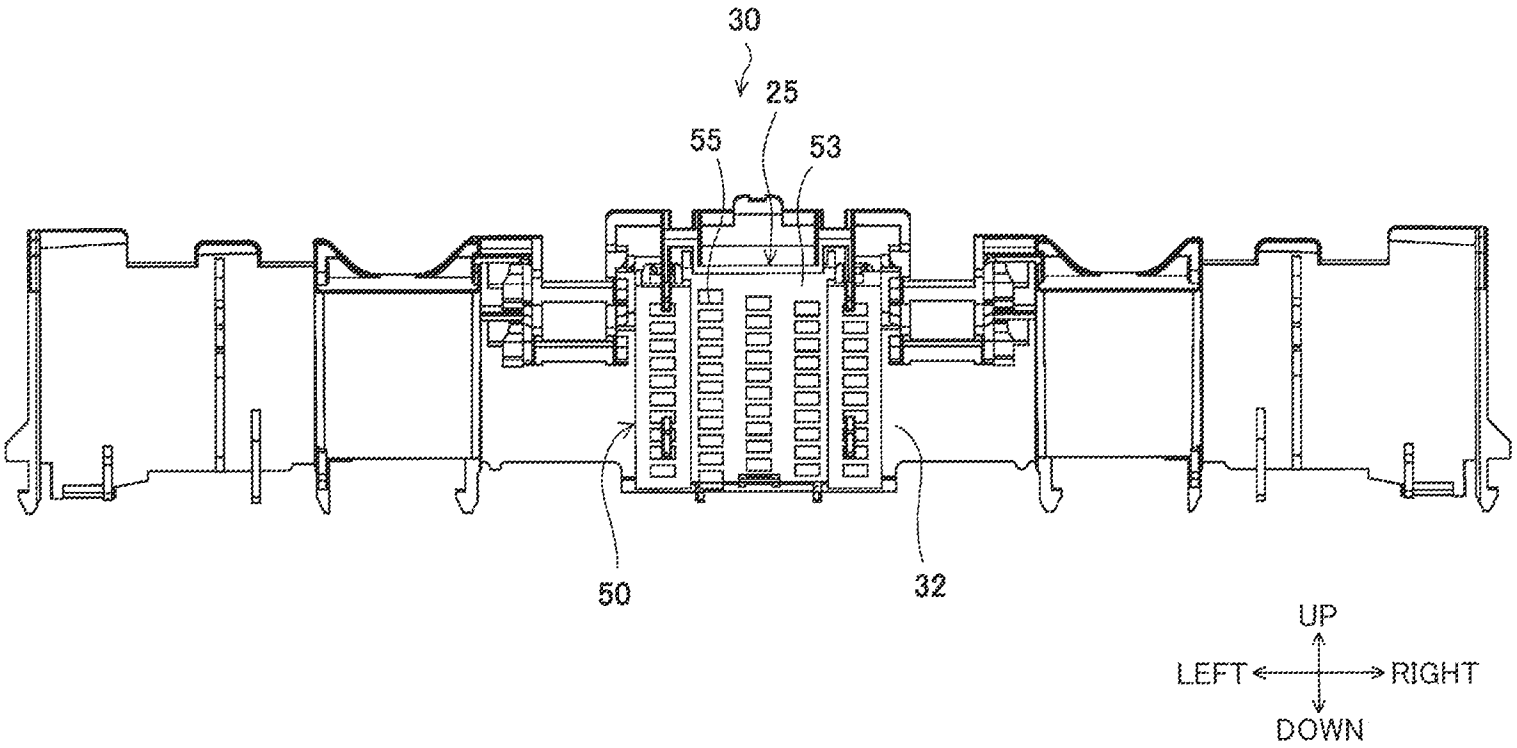
FIG. 3 is a rear view of the inclined member and the sheet separating member those illustrated in FIG. 2 in the sheet feeding device according to the first embodiment.

The base ends 41 of the separation pieces 40 for each of the separation piece array 40*a* is connected to the bottom surface of the groove portion 54 for the corresponding slit 33, such that the separation pieces 40 and the support portion 50 are formed integrally with each other. As illustrated in FIGS. 3 and 5, each of the bottom walls 53 is formed with through-holes 55 at positions above and below a portion at which the bottom wall 53 and the base end 41 of each of the separation pieces 40 are connected to each other. That is, each of the through-holes 55 is formed at a position between the two neighboring separation pieces 40 in the inclined direction B, and penetrates the bottom wall 53. The through-hole 55 allows an interior of the groove portion 54 to be in communication with an outside of the groove portion 54. Note that the through-holes 55 may be provided in at least one of positions below and above the connecting portion of the base ends 41 and the bottom wall 53.

As illustrated in FIG. 6, the separation pieces 40 are positioned between the corresponding right wall 51 and left wall 52 in the left-right direction. The separation pieces 40 are elected from the bottom wall 53 and protrudes further frontward than the inclined surface 31 through the corresponding slit 33. The right wall 51 and the left wall 52 extend in the inclined direction B over the separation pieces 40 for the corresponding separation piece array 40*a*. That is, each of the right walls 51 and the left walls 52 are used commonly as the support portion 50 for supporting the plurality of separation pieces 40 constituting the corresponding one of the separation piece arrays 40*a*. However, a plurality of right walls 51 and a plurality of left walls 52 may be provided for supporting a plurality of separation pieces 40 in one-to-one correspondence.

[Functions and Effects Obtained by Sheet Separating Member]

As described above, in the sheet feeding device 20, the sheet separating member 25 includes the plurality of separation pieces 40 and the support portion 50. Each of the separation pieces 40 is made from resin and has the distal end 42 protruding further frontward than the inclined surface 31. The support portion 50 is made from resin and supports the base end 41 of each of the separation piece 40 at a position closer to the back surface 32 than to the inclined surface 31. The separation pieces 40 are supported by the support portion 50 to be resiliently deformable so that the separation pieces 40 are movable independently from each other away from the sheet placement surface 21*a* in the inclined direction B and toward the back surface 32 in the normal direction C.

With this configuration, the distal ends 42 of the separation pieces 40 are movable not only in the inclined direction B but also in a direction from the inclined surface 31 toward the back surface 32 to be depressed toward the back surface 32. Therefore, the separation pieces 40 can provide sufficient resilient deformation even though the separation pieces 40 are made from resin. Hence, upon abutment of the leading edge of a sheet A moving upward on the inclined surface 31 in the incline direction B against the separation pieces 40, the separation pieces 40 are brought into resilient deformation to be pivotally moved about the base end 41, in such a manner that the distal ends 42 are moved upward in the inclined direction B and rearward in the normal direction C, thereby attaining efficient separation of the sheet A from the remaining sheet(s) A in the stack of sheets A.

Further, the base ends 41 of the separation pieces 40 are supported by the support portion 50 at positions closer to the back surface 32 than to the inclined surface 31. Therefore, in a case where at least one distal end 42 of the separation pieces 40 are moved, unintentional abutment of the distal end 42 against the neighboring separation piece 40 can be restrained, since the distal end 42 is movable to be depressed toward the back surface 32. Accordingly, compared to the conventional configuration, the number of the separation pieces 40 per unit area on the inclined surface 31 (i.e., the density of the separation pieces 40 on the inclined surface 31) can be increased.

Further, the plurality of the separation pieces 40 are movable independently from each other. Accordingly, at least one of the plurality of the separation pieces 40 can apply suitable load to a sheet A for separating the sheet A from the stack of sheets A when the sheet A is brought into abutment with the sheet separating member 25. Hence, the sheet feeding device 20 can more stably perform separation of the sheet A, whereby efficient separation of the sheet A can be performed even if the great number of sheets A are accommodated in the sheet accommodating unit 21.

Further, each of the separation pieces 40 is inclined relative to the normal direction C such that the distal end 42 is positioned further away from the sheet placement surface 21*a* than the base end 41 is from the sheet placement surface 21*a*. With the above configuration, the separation piece 40 is more likely to be pivotally moved such that the distal end 42 is moved not only in the direction away from the sheet placement surface 21*a* in the inclined direction B but also rearward in the normal direction C to be depressed rearward from the inclined surface 31 toward the back surface 32. Accordingly, the separation pieces 40 can perform separation of the uppermost sheet A from the stack of sheets A while avoiding such a case that the separation pieces 40 obstruct movement of the uppermost sheet A.

Further, in the sheet feeding device 20, an amount of movement of the distal end 42 away from the sheet placement surface 21*a* in the inclined direction B is greater than an amount of movement of the distal end 42 toward the back surface 32 in the normal direction C. With this configuration, a state where the distal end 42 protrudes outward than the inclined surface 31 can be maintained while the separation piece 40 is depressed rearward toward the back surface 32. Hence, a period of time during which the distal end 42 abuts against the leading edge of the sheet A can be relatively prolonged, and a load to be applied from the separation piece 40 to the sheet A can be made relatively small. Accordingly, forcible separation of the uppermost sheet A within a shorten period of time can be effectively eliminated, thereby enhancing performance of separation of the uppermost sheet A.

Further, in the sheet feeding device 20, the support portion 50 includes a plurality of groove portions 54 recessed from the inclined surface 31 toward the back surface 32, and the plurality of separation pieces 40 are formed integrally with the support portion 50 such that the separation pieces 40 are elected from the bottom surface of the groove portion 54. With this configuration, in case of the integral molding of the sheet separating member 25, a molded product can be easily released from a metal mold. Therefore, the plurality of separation pieces 40 can be arranged in high density at the time of integral molding of the sheet separating member 25.

Further, the bottom wall 53 constituting the groove portion 54 is formed with the through-hole 55 at a position at least one of below and above the base end 41 of each of the separation pieces 40 in the inclined direction B. With this configuration, even if paper dust of the sheet A moving on the inclined surface 31 enters the groove portion 54, the paper dust can be discharged out the groove portion 54 through the through-hole 55, thereby restraining accumulation of paper dust within the groove portion 54.

Further, in the sheet feeding device 20, the distal end 42 of each of the separation pieces 40 is constituted by the plurality of protrusions 44 arranged in the inclined direction B. With this configuration, the sheet A moving on the inclined surface 31 is brought into abutment against the plurality of protrusions 44 of single separation piece 40. Therefore, a plurality of opportunity for separating the uppermost sheet A can be attained with respect to the single separation piece 40, thereby further improving performance for separating the uppermost sheet A.

Further, a plurality of openings (i.e., the plurality of slits 33) are open on the inclined surface 31 to be arranged in the widthwise direction perpendicular to the inclined direction B. The plurality of openings allow the separation pieces 40 to protrude therethrough. Moreover, the support portion 50 is connected to portions of the inclined member 30 defining both edges in the widthwise direction of the openings (the slits 33) so that the support portion 50 is bridged over each of the openings (the slits 33) in the widthwise direction at a position closer to the back surface 32 than to the inclined surface 31.

With this configuration, the portions of the inclined member 30 defining the both edges in the widthwise direction of the slits 33 can be reinforced by the support portion 50. Therefore, flatness of the inclined surface 31 of the inclined member 30 can be maintained at high level, thereby facilitating smooth movement of the sheet A along the inclined surface 31. Further, a posture of the separation piece 40 connected to the inclined member 30 through the support portion 50 can be stabilized, thereby further improving performance for separating the uppermost sheet A.

[Auxiliary Inclined Surface and Sheet Guide Surface]

As illustrated in FIGS. 4 and 5, each of the separation pieces 40 further includes an auxiliary member having an auxiliary inclined surface 46 and a sheet guide surface 47. The auxiliary inclined surface 46 is positioned closer to the distal end 42 than to the base end 41 of the separation piece 40. For example, the auxiliary inclined surface 46 is positioned in alignment with the bottom of the slit portion 43 formed at the distal end 42 in the extending direction D of the separation piece 40 (i.e., a bottom portion of the two protrusions 44 of the separation piece 40). Accordingly, the protrusions 44 constituting the distal end 42 of the separation piece 40 protrude from the auxiliary inclined surface 46.

The auxiliary member has a substantially U-shape to surround the protrusions 44. The auxiliary inclined surface 46 includes a right surface 46*a*, a left surface 46*b*, and a lower surface 46*c*. The right surface 46*a* extends rightward from right edges of the protrusions 44, the left surface 46*b* extends leftward from left edges of the protrusions 44, and the lower surface 46*c* extends diagonally downward from lower edges of the protrusions 44.

The right surface 46*a*, the left surface 46*b* and the lower surface 46*c* are flat surfaces flush with each other to constitute the flat auxiliary inclined surface 46. In a case where the separation piece 40 is not pivotally moved about the base end 41, the auxiliary inclined surface 46 is flush with the inclined surface 31. On the other hand, in a case where the separation piece 40 is pivotally moved so that the distal end 42 is depressed rearward into the slit 33, the auxiliary inclined surface 46 is inclined relative to the inclined surface 31.

In the meantime, the auxiliary member includes a center portion 48*a*, an upper extension portion 48*b*, and a lower extension portion 48*c*. The center portion 48*a* is positioned between the upper extension portion 48*b* and the lower extension portion 48*c* in the inclined direction B. The upper extension portion 48*b* has a right portion and a left portion extending upward from the center portion 48*a* in the inclined direction B, while the lower extension portion 48*c* extends downward from the center portion 48*a* in the inclined direction B.

The upper extension portion 48*b* has a front surface that constitutes a part of the right surface 46*a* and a part of the left surface 46*b*. Put another way, the front surface of the right portion of the upper extension portion 48*b* serves as a part of the right surface 46*a* positioned upward than the protrusions 44. Also, the front surface of the left portion of the upper extension portion 48*b* serves as a part of the left surface 46*b* positioned upward than the protrusions 44. With this arrangement, the right surface 46*a* and the left surface 46*b* have portions upward of the protrusions 44. Each of the left portion and the right portion of the upper extension portion 48*b* has a substantially triangle shape or a trapezoidal shape, for example, and a gap therebetween in the left-right direction is gradually increased as extending upward.

The center portion 48*a* has a front surface that constitutes the remaining part of the right surface 46*a*, the remaining part of the left surface 46*b*, and the lower surface 46*c*. Specifically, of the front surface of the center portion 48*a*, a portion positioned rightward of the protrusions 44 serves as the remaining part of the right surface 46*a*, a portion positioned leftward of the protrusions 44 serves as the remaining part of the left surface 46*b*, and the remaining part of the front surface, i.e., a portion positioned lower than the protrusions 44 serves as the lower surface 46*c*. That is, the front surface of the center portion 48*a* and the front surface of the upper extension portion 48*b* is the auxiliary inclined surface 46 (i.e., the right surface 46*a*, the left surface 46*b*, and the lower surface 46*c*).

The lower extension portion 48*c* is positioned lower than the lower surface 46*c*, and has a front surface serving as the sheet guide surface 47. That is, the sheet guide surface 47 is positioned lower than the lower surface 46*c* of the auxiliary inclined surface 46. The sheet guide surface 47 is of a flat surface extending diagonally downward and inclined relative to the auxiliary inclined surface 46 at a constant angle.

The auxiliary member including the center portion 48*a*, the upper extension 48*b*, and the lower extension portion 48*c* has a dimension in the extending direction D smaller than a half of the dimension in the extending direction D of the entire separation piece 40, for example. Preferably, the dimension in the extending direction D of the auxiliary member is smaller than one-third of the dimension in the extending direction D of the separation piece 40.

That is, the separation piece 40 further includes a protruding portion 49 extending rearward from the auxiliary member in the extending direction D. In other words, the protruding portion 49 extends rearward from the center portion 48*a*, the upper extension portion 48*b*, and the lower extension portion 48*c* in the extending direction D. The center 48*a*, the upper extension portion 48*b*, and the lower extension portion 48*c* have maximum dimensions in the left-right direction equal to a dimension in the left-right direction of the protruding portion 49. In other words, a dimension in the left-right direction of the separation piece 40 excluding the distal end 42 is equal to a dimension in the left-right direction of the auxiliary inclined surface 46. Further, a dimension of the protruding portion 49 in a direction perpendicular to the extending direction D is smaller than a dimension in the direction of the auxiliary member.

[Functions and Effects Obtained by Auxiliary Inclined Surface]

The sheet feeding device 20 includes the auxiliary member having the auxiliary inclined surface 46 provided at both sides of the distal end 42 in the widthwise direction (the left-right direction) perpendicular to the inclined direction B and the normal direction C. The auxiliary inclined surface 46 is positioned closer to the back surface 32 of the inclined member 30 than the distal end 42 is to the back surface 32. Further, the support portion 50 movably supports the separation piece 40 and the auxiliary inclined surface 46.

With the above configuration, since the auxiliary inclined surface 46 extends outward in the left-right direction than the distal end 42, a gap between the distal end 42 and the inclined surface 31 is closed with the auxiliary inclined surface 46. Accordingly, entry of a sheet A into the gap between the distal end 42 and the inclined surface 31 can be prevented, thereby attaining stable feeding of the sheet A.

Further, since the auxiliary inclined surface 46 is provided to be flush with the inclined surface 31, a sheet A can be easily moved along the inclined surface 31 and the auxiliary inclined surface 46.

Further, the auxiliary inclined surface 46 is provided adjacent to the distal end 42 at a position close to the sheet placement surface 21*a* in the inclined direction B. The sheet guide surface 47 is positioned closer to the sheet placement surface 21*a* than the auxiliary inclined surface 46 is to the sheet placement surface 21*a* in the inclined direction B, and is inclined toward the back surface 32 as extending toward the sheet placement surface 21*a*.

With this configuration, the sheet guide surface 47, the lower surface 46*c* of the auxiliary inclined surface 46, and the protrusions 44 of the distal end 42 are arranged in this order in the inclined direction B (i.e., the sheet conveying direction). Accordingly, a sheet A passing along the inclined surface 31 is moved on the components in the order of the sheet guide surface 47, the lower surface 46*c*, and the protrusions 44 in the sheet conveying direction, and the leading edge of the sheet A is guided to the distal end 42 through the lower surface 46*c* by the sheet guide surface 47. Therefore, the sheet A can be efficiently separated from the stack of sheets A at the distal end 42. Moreover, since the separated sheet A is guided stably by the auxiliary inclined surface 46 surrounding the distal end 42, feeding of the sheet A can be more securely performed.

Further, in the sheet feeding device 20, the auxiliary inclined surface 46 has a portion positioned farther away from the sheet placement surface 21*a* than the distal end 42 is from the sheet placement surface 21*a* in the inclined direction B. With this configuration, a gap provided between the distal ends 42 of the two neighboring separation pieces 40 in the inclined direction B can be made small by virtue of the portion of the auxiliary inclined surface 46, whereby entry of a sheet A into the gap between the two neighboring distal ends 42 can be suppressed.

Accordingly, a sheet A can be more securely fed by the sheet feeding device 20 while avoiding disability in feeding of the sheet A and realizing guiding of the sheet A toward another separation piece 40 positioned upward than the separation piece 40 in the inclined direction B.

Further, the dimension in the widthwise direction (the left-right direction) of the separation piece 40 excluding the distal end 42 is equal to the dimension in the widthwise direction of the auxiliary inclined surface 46. With this configuration, a strength of the separation piece 40 can be enhanced against a load applied to the separation piece upon abutment of a sheet A against the separation piece 40, thereby more securely separating the sheet A from the stack of sheets A.

Note that the auxiliary inclined surface 46 may be provided to be flush with the inclined surface 31 when the separation piece 40 is resiliently deformed so that the distal end 42 is moved away from the sheet placement surface 21*a* in the inclined direction B. In this case, the auxiliary inclined surface 46 and the inclined surface 31 are on the same plane when the distal end 42 is depressed into the slit 33 in accordance with the abutment of a sheet A against the distal end 42. Hence, the sheet A can be smoothly moved on the inclined surface 31 and the auxiliary inclined surface 46 those are flush with each other.

[Modification to First Embodiment]

Next, a sheet feeding device according to a modification to the first embodiment will be described with reference to FIG. 7, wherein like parts and components are designated by the same reference numerals and characters as those shown in the first embodiment.

The sheet feeding device according to this modification includes a sheet separating member 125 and an inclined member 130 having an inclined surface 131. The sheet separating member 125 includes a plurality of separation piece units 126 each including the separation piece array 40*a* constituted by the plurality of separation pieces 40 arranged in line in the inclined direction B, and a pair of wall portions (a right wall 151 and a left wall 152) extending in the inclined direction B.

The separation piece array 40*a* is positioned between the right wall 151 and the left wall 152 in the left-right direction, and integrally formed with the right wall 151 and the left wall 152. Each of the separation piece units 126 is detachable from and attachable to the inclined member 130. Each of the right walls 151 has a front surface 151*a*, and each of the left walls 152 has a front surface 152*a*. The front surfaces 151*a* and the front surfaces 152*a* are flush with the inclined surface 131 when the separation piece units 126 are attached to the inclined member 130.

Specifically, the inclined member 130 is formed with a plurality of (four in this modification) grooves 134 extending in the inclined direction B and recessed rearward in the normal direction C from the inclined surface 131. Each of the grooves 134 defines a rectangular opening 134*a* open on the inclined surface 131. Each of the grooves 134 includes a right side wall 134*b*, a left side wall 134*c*, and a bottom wall 134*d*.

Each of the right side wall 134*b* and the left side wall 134*c* has a front end connected to the back surface 32 of the inclined member 130, and protrudes rearward in the normal direction C from the back surface 32. The right side wall 134*b* extends along a right edge of the rectangular opening 134*a*, and the left side wall 134*c* extends along a left edge of the rectangular opening 134*a*. In the two neighboring openings 134*a* in the left-right direction, the left side wall 134*c* of the right opening 134*a* and the right side wall 134*b* of the left opening 134*a* are formed integrally with each other. However, these right side wall 134*b* and the left side wall 134*c* may be provided independently from each other.

The bottom wall 134*d* has a right end connected to a rear end of the right side wall 134*b*, and a left end connected to a rear end of the left side wall 134*c* such that the bottom wall 134*d* is bridged over the right side wall 134*b* and the left side wall 134*c* in the left-right direction. The bottom wall 134*d* has a front surface extending perpendicular to the normal direction C and faces the rectangular opening 134*a*. Accordingly, the rectangular opening 134*a* is surrounded by the right side wall 134*b*, the left side wall 134*c*, and the bottom wall 134*d*. Each of the bottom wall 134*d* is formed with engagement holes 134*e*.

Each of the separation piece unit 126 includes a support portion 150 in addition to the separation piece array 40*a*. The support portion 150 includes the right wall 151 and the left wall 152. Contrary to the first embodiment, the front end (the front surface 151*a*) of the right wall 151 and the front end (the front surface 152*a*) of the left wall 152 are not engaged with the inclined member 130. Instead, each of the right wall 151 and the left wall 152 has a rear end provided with an engagement pawl 151*b* engageable with a corresponding one of the engagement holes 134*e* of the bottom wall 134*d*. Except the above point, the configuration of the support portion 150 illustrated in FIG. 7 is the same as that of the support portion 50 of the first embodiment illustrated in FIG. 3.

The plurality of the separation piece units 126 is provided in one-to-one correspondence with the plurality of grooves 134. Thus, four of the separation piece units 126 are provided in this modification. Each of the separation piece units 126 is fitted into and fixed to a corresponding one of the grooves 134 by the engagement of the engagement pawls 151*b* with the engagement holes 134*e*. As a result of attachment of the separation piece units 126 to the corresponding grooves 134, the front surfaces 151*a* and 152*a* of the right and left side walls 151 and 152 are flush with the inclined surface 131 of the inclined member 130.

With this configuration, the plurality of separation pieces 40 are modularized as the separation piece units 126. Therefore, each of the separation piece units 126 can be easily replaced with a new separation piece unit 126 even when any of the separation pieces 40 is broken. Further, since the front surfaces 151*a* and 152*a* of the right and left side walls 151 and 152 are flush with the inclined surface 131 upon attachment of the separation piece unit 126 to the inclined member 130, setting of the protruding amount of the separation pieces 40 relative to the inclined surface 131 can be facilitated by setting the protruding amount of the separation pieces 40 relative to the front surfaces 151*a* and 152*a* when molding the separation piece unit 126.

Second Embodiment

Next, a sheet feeding device 220 according to a second embodiment will be described with reference to FIGS. 8 through 11 wherein like parts and components are designated by the same reference numerals as those shown in the first embodiment to avoid duplicating description.

The sheet feeding device 220 includes a sheet separating member 225 including a plurality of separation piece array constituted by a plurality of separation pieces and a plurality of support portions those made from resin. In the second modification, a plurality of first separation pieces 260 and a plurality of second separation pieces 270 having configurations different from each other are provided. Also, the plurality of support portions includes a plurality of first support portions 280 for supporting the corresponding one of the first separation pieces 260, and a plurality of second support portions 290 for supporting the corresponding one of the second separation pieces 270. Note that the sheet separating member 225 may be provided with either one of the first separation pieces 260 and the first support portions 280 supporting the same, and the second separation pieces 270 and the second support portion 290 supporting the same.

Figure 9:
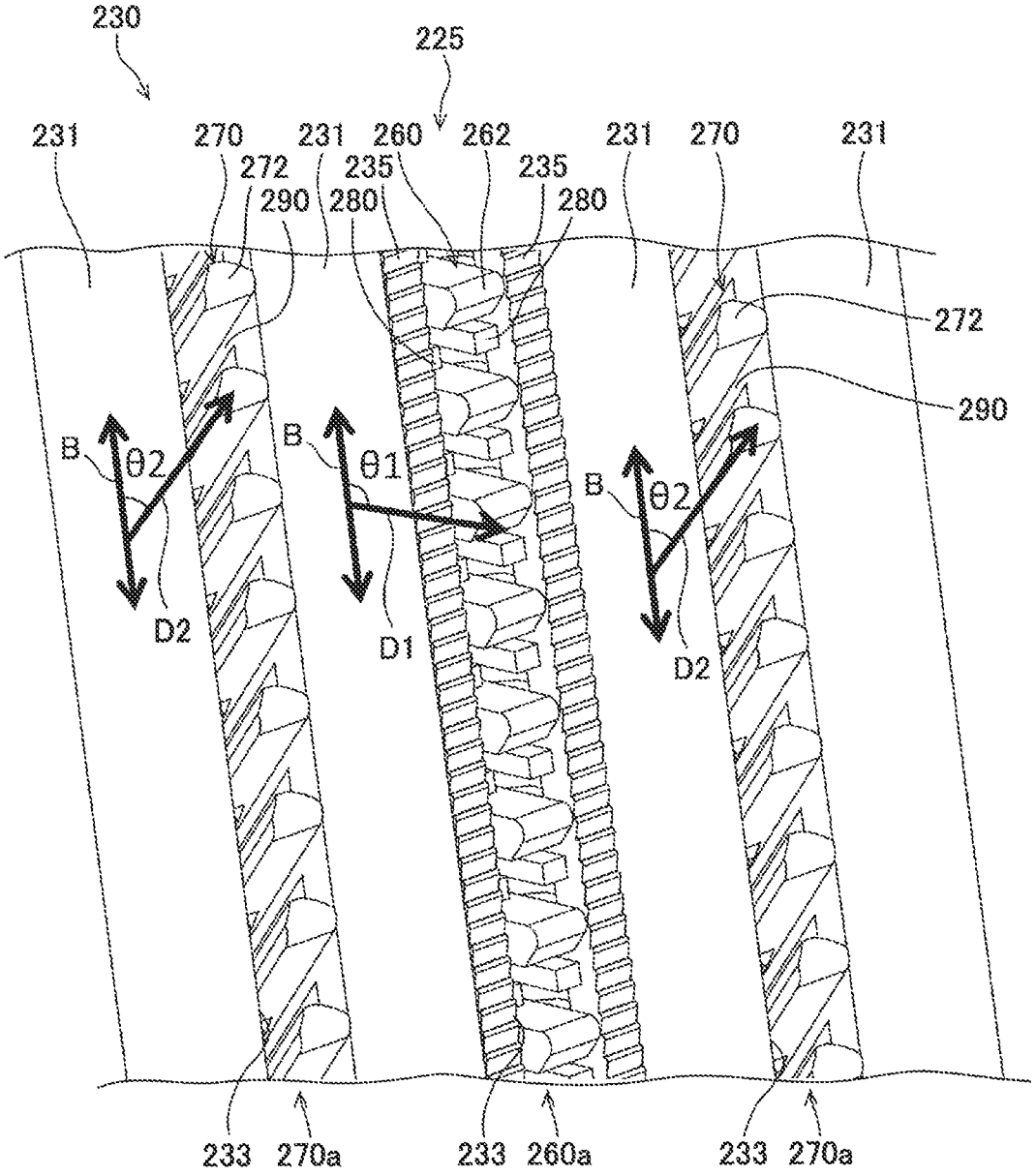
FIG. 9 is a partial enlarged perspective view of the inclined member and the sheet separating member those illustrated in FIG. 8 in the sheet feeding device according to the second embodiment.

A plurality of openings are open on an inclined surface 231 of an inclined member 230. In the second embodiment, three slits 233 having a rectangular shape and extending in the inclined direction B are formed in the inclined member 230. The plurality of slits 233 are arranged in parallel to be spaced apart from each other in the left-right direction. A portion of the inclined surface 231 defining both edges in the left-right direction of the slit 233 formed between the other two slits 233 (i.e., the center slit 233 of the three slits 233) is formed with a plurality of indentations 235. As best shown in FIG. 9, the plurality of indentations 235 are arranged in the inclined direction B along the center slit 233 and having a blade-like shape to protrude from the inclined surface 231.

The plurality of the first separation pieces 260 are arranged in parallel to be spaced apart from each other in the inclined direction B to constitute a first separation piece array 260*a*. Further, the plurality of second separation pieces 270 are arranged in parallel to be spaced apart from each other in the inclined direction B to constitute a second separation piece array 270*a*. In the second embodiment, second separation piece arrays 270*a* are provided. The first separation piece array 260*a* is positioned between and spaced apart from the two second separation piece arrays 270*a* in the left-right direction. The first separation piece array 260*a* and the second separation piece arrays 270*a* are provided within the three slits 233 in one-to-one correspondence.

Figure 10:
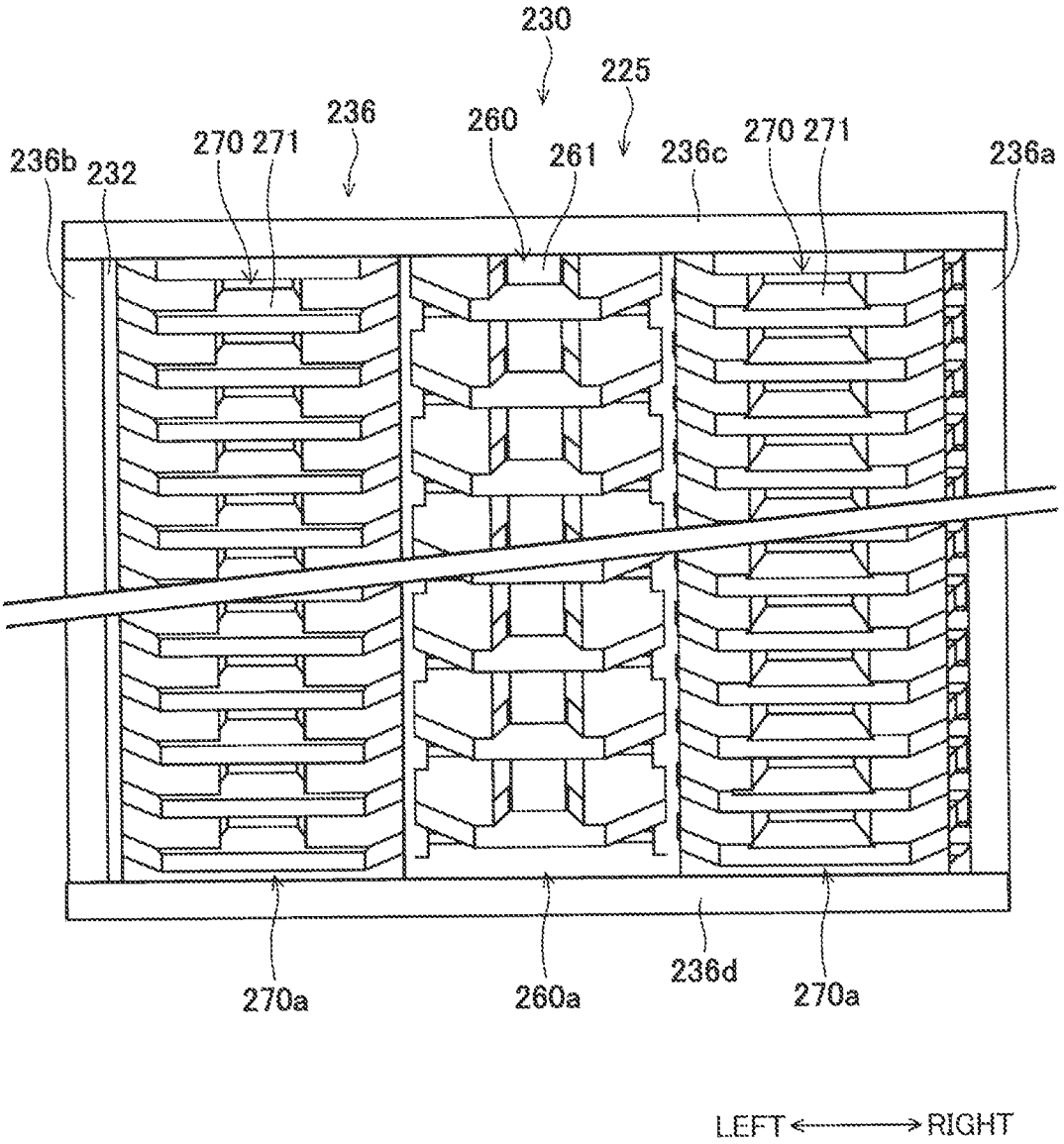
FIG. 10 is a partial rear view of the inclined member and the sheet separating member those illustrated in FIG. 8 in the sheet feeding device according to the second embodiment.

As illustrated in FIG. 10, a plurality of reinforcing ribs 236 is provided at a back surface 232 of the inclined member 230. The reinforcing ribs 236 include four reinforcing ribs, i.e., a right reinforcing rib 236*a*, a left reinforcing rib 236*b*, an upper reinforcing rib 236*c*, and a lower reinforcing rib 236*d*. Each of these reinforcing ribs 236*a* to 236*d* has a flat plate-like shape and has a front end connected to the back surface 232, and is elected rearward from the back surface 232 in the normal direction C.

The right reinforcing rib 236*a* and the left reinforcing rib 236*b* extend in the inclined direction B and spaced away from each other in the left-right direction. The upper reinforcing rib 236*c* and the lower reinforcing rib 236*d* extend in the left-right direction and are positioned spaced away from each other in the inclined direction B. Hence, the reinforcing ribs 236 constitute a rectangular frame-like shape surrounding the first separation piece array 260*a* and the two second separation piece array 270*a*.

Figure 11:
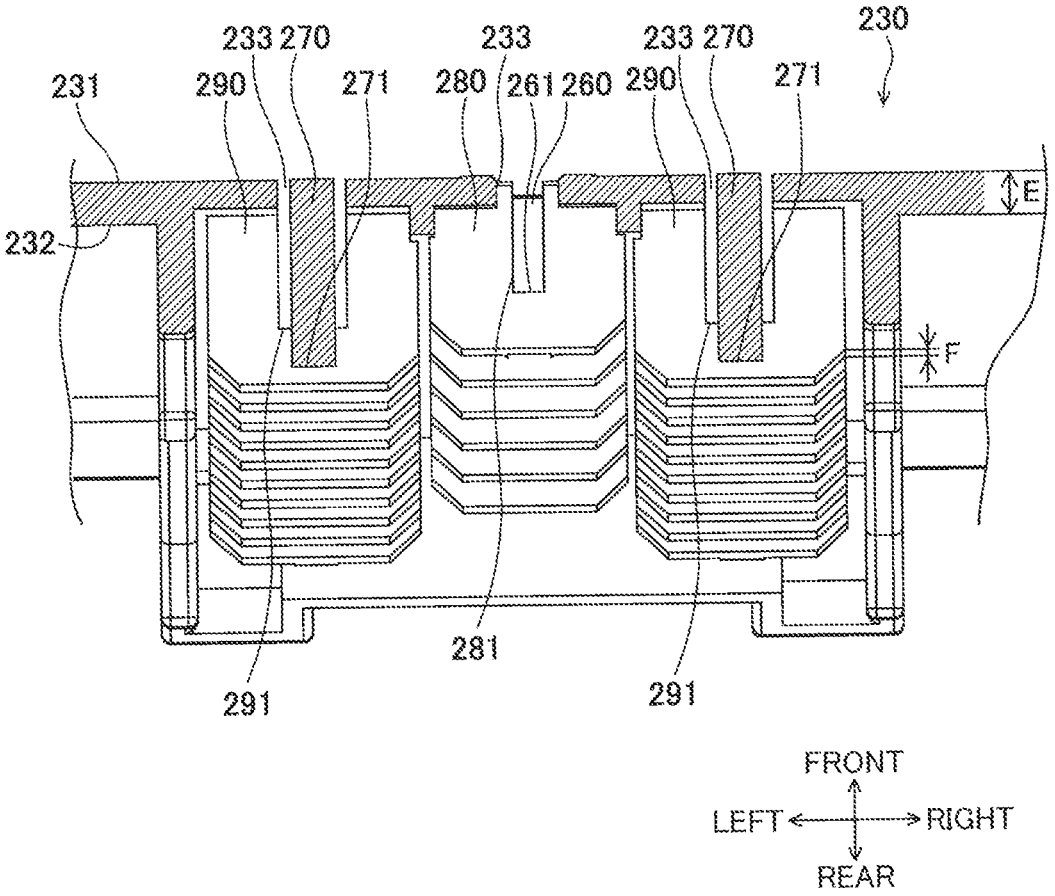
FIG. 11 is a partial cross-sectional view of the inclined member and the sheet separating member those illustrated in FIG. 8 in the sheet feeding device according to the second embodiment as viewed from an upper side thereof.

As illustrated in FIGS. 9 and 11, each of the first separation pieces 260 has a rod-like shape having rectangular cross-section, and has a first base end 261 and a first distal end 262. Each of the first separation pieces 260 linearly extends diagonally upward and frontward from the first base end 261 to the first distal end 262 in an extending direction indicated by an arrow D1 in FIG. 9. Each of the first separation pieces 260 is inclined relative to the inclined direction B by an angle θ1. Each of the first separation pieces 260 has a dimension in a direction perpendicular to the extending direction D1 and the left-right direction smaller than a dimension in the extending direction D1 thereof and a dimension in the left-right direction thereof. The dimension in the left-right direction of the first separation piece 260 is smaller than the dimension in the extending direction D1 thereof.

The first distal end 262 is positioned further frontward than the inclined surface 231, whereas the first base end 261 is positioned further rearward than the back surface 232. A direction in which the first distal end 262 protrudes from the inclined surface 231, that is, the extending direction D1 of the first separation piece 260 in the direction from the first base end 261 to the first distal end 262 is parallel to the normal direction C, or inclined diagonally upward and frontward relative to the normal direction C. For example, of angles defined between the extending direction D1 (the direction in which the first distal end 262 protrudes) and the inclined direction B (the inclined surface 231), the smaller angle (i.e., the acute angle) θ1 is greater than 45 degrees and smaller than or equal to 90 degrees.

Each of the first support portions 280 has a plate-like shape, and has a U-shape recessed rearward to form a first recess 281. Each of the first support portions 280 has a front end that is fixed to the back surface 232 such that the first recess 281 is in alignment with the corresponding slit 233. That is, each of the first support portions 280 is positioned rearward of the back surface 232 to bridge over the slit 233.

The plurality of first separation pieces 260 and the plurality of first support portions 280 are provided in one-to-one correspondence. Specifically, the first base end 261 of each of the first separation pieces 260 is connected to a front surface of the corresponding one of the first support portions 280 at a position further rearward than the first recess 281. Accordingly, the first separation piece 260 and the corresponding first support portion 280 are formed integrally with each other to be movable together. The plurality of first support portions 280 are arranged in line to be spaced apart from one another in the inclined direction B.

Each of the first separation pieces 260 upstands from the first support portion 280 at the first base end 261 and extends frontward in parallel or substantially parallel to the corresponding one of the first support portions 280. The first distal end 262 protrudes from the front surface of the first support portion 280 through the slit 233 to a position frontward of the inclined surface 231. Hence, a combination of the first separation piece 260 and the corresponding first support portion 280 constitute a substantially U-shape so that the first support portion extends rearward from the front end there to the rear end thereof, and the first separation piece 260 extends frontward from the first base end 261 to the first distal end 262 through the portion at which the first separation piece 260 and the first support portion 280 are connected to each other. The first distal end 262 extends in the left-right direction, and is curved relative to the inclined direction B.

Each of the second separation pieces 270 has a rod-like shape having a substantially triangular cross-section, and has a second base end 271 and a second distal end 272. Each of the second separation piece 270 linearly extends diagonally upward and frontward from the second base end 271 to the second distal end 272 in an extending direction D2 indicated by an arrow D2 in FIG. 9. Each of the second separation pieces 270 is inclined relative to the inclined direction B by an angle θ2.

The second distal end 272 is positioned further frontward than the inclined surface 231, and the second base end 271 is positioned further rearward than the back surface 232. The second separation pieces 270 has a portion protruding from the inclined surface 231, and the portion has a dimension in the normal direction C smaller than or equal to a dimension in the normal direction C of a protruding portion of the first separation piece 260 protruding from the inclined surface 231.

A direction in which the second distal end 272 protrudes from the inclined surface 231, that is, the extending direction D2 (see FIG. 9) of the second separation pieces 270 in the direction from the second base end 271 to the second distal end 272 is inclined diagonally upward and frontward relative to the normal direction C. Of angles defined between the extending direction D2 (the direction in which the second distal end 272 protrudes) and the inclined direction B (the inclined surface 231), the smaller angle (i.e., the acute angle) θ2 is smaller than the angle θ1 between the extending direction D1 and the inclined direction B. For example, the angle θ2 is greater than 45 degrees and smaller than 90 degrees.

Each of the second support portions 290 has a substantially plate-like shape, and has a U-shape recessed rearward to form a second recess 291. Each of the second support portions 290 has a front end fixed to the back surface 232 such that the second recess 291 is in alignment with the corresponding slit 233. That is, each of the second support portions 290 is positioned rearward of the back surface 232 to bridge over the slit 233.

The plurality of second separation pieces 270 and the second support portions 290 are provided in one-to-one correspondence. Specifically, the second base end 271 of each of the second separation pieces 270 is connected to a bottom surface of the second recess 291 of the corresponding one of the second support portions 290. With the above configuration, each of the second separation pieces 270 is formed integrally with and movable together with the corresponding one of the second support portions 290. The plurality of the second support portions 290 are arranged in line to be spaced apart from one another in the inclined direction B.

Each of the second separation piece 270 extends to be inclined diagonally upward and frontward relative to the corresponding one of the second support portion 290, and protrudes frontward of the inclined surface 231 from a front end (i.e., a bottom surface of the second recess 291) of the second support portion 290 through the corresponding slit 233. Hence, a combination of the second support portion 290 and the second separation piece 270 constitute a substantially U-shape such that the second support portion 290 extends rearward from the front end to the rear end thereof, and the second separation piece 270 extends upward from the second base end 271 to the second distal end 272 through the portion at which the second separation piece 270 and the second support portion 290 are connected to each other.

[Functions and Effects Obtained by Sheet Separation Member]

As described above, the sheet separating member 225 of the sheet feeding device according to the second embodiment includes the plurality of first separation pieces 260 and the plurality of first support portions 280 those are made of resin. The first distal end 262 of each of the first separation pieces 260 protrudes from the inclined surface 231. Each of the first support portion 280 supports the first base end 261 of the corresponding one of the second separation piece 270 at a position closer to the back surface 232 than to the inclined surface 231.

Accordingly, the second separation pieces 270 is supported by the corresponding second support portions 290 so as to be movable away from the sheet placement surface 21*a* (upward) in the inclined direction B and toward the back surface 232 (rearward) in the normal direction C independently from one another.

With this configuration, each of the first separation pieces 260 is pivotally movable about the first base end 261 such that the first distal end 262 is moved in the direction away from the sheet placement surface 21*a*, and rearward in the normal direction C, whereby separation of the uppermost sheet A from the stack of sheets A can be efficiently performed. Since each of the first separation piece 260 is movable so as to be depressed rearward into the corresponding slit 233, unintentional abutment of the first distal end 262 against the neighboring 260 can be suppressed when any first separation piece 260 is moved on the inclined surface 231. Accordingly, the sheet separating member 225 can be provided while improving density of the first separation pieces 260 on the inclined surface 231.

Further, since at least one of the plurality of the first separation pieces 260 can perform separation of the uppermost sheet when the sheet A is brought into abutment against the sheet separating member 225, performance for separating the sheet A can further be enhanced. Note that the second separation pieces 270 and the corresponding second support portions 290 can exhibit functions and effects the same as those of the first separation pieces 260 and the first support portions 280.

Further, each of the first separation pieces 260 is inclined relative to the normal direction C such that the first distal end 262 is positioned farther away from the sheet placement surface 21*a* than the first base end 261 is from the sheet placement surface 21*a* in the inclined direction B, i.e., the first distal end 262 is positioned further upward than the first base end 261 in the inclined direction B.

With this configuration, the first separation piece 260 is likely to be pivotally moved such that the first distal end 262 is moved upward in the inclined direction B and rearward in the normal direction C. Therefore, the first separation piece 260 can perform separation of the uppermost sheet A from the stack of sheets A while avoiding a state where the first separation piece 260 becomes obstacle for the movement of the separated sheet A. Note that the second separation pieces 270 and the corresponding second support portions 290 can exhibit functions and effects the same as those of the first separation pieces 260 and the first support portions 280 described above.

Further, the inclined surface 231 is formed with the plurality of openings (the plurality of slits 233) arranged in the widthwise direction perpendicular to the inclined direction B. Each of the openings allow the first separation pieces 260 to protrude therethrough. Moreover, the first support portions 280 are connected to the back surface 232 of the inclined member 230 at positions defining both edges of each of the openings (the slits 233) in the widthwise direction to bridge over each of the openings.

With this configuration, the portions of the inclined member 230 defining the both edges of slit 233 in the widthwise direction can be reinforced by the first support portions 280. Therefore, flatness of the inclined surface 231 of the inclined member 230 can be stably maintained, thereby enhancing smooth movement of the sheet A along the inclined surface 231. Further, since posture of the first separation pieces 260 connected to the inclined member 230 through the corresponding first support portions 280 can be stabilized, performance of the first separation pieces 260 for separating the uppermost sheet A can further be improved. The second separation pieces 270 and the corresponding second support portions 290 can exhibit functions and effects the same as those of the first separation pieces 260 and the first support portions 280 described above.

The plurality of first separation pieces 260 are arranged in line in the inclined direction B to constitute the first separation piece array 260*a* extending in the inclined direction B. Also, the plurality of second separation pieces 270 are arranged in line in the inclined direction B and constitute the second separation piece array 270*a* extending in the inclined direction B. The plurality of separation piece arrays, i.e., the first separation piece array 260*a* and the two second separation piece array 270*a* are arranged in the widthwise direction. In the neighboring first separation piece array 260*a* and the second separation piece array 270*a*, the first support portions 280 and the second support portions 290 are disposed alternately to each other in the inclined direction B, i.e., positions of the first support portions 280 and positions of the second support portions 290 are displaced from each other in the inclined direction B.

With the above configuration, since the first support portions 280 and the second support portions 290 are alternately arranged in the inclined direction B in the first separation piece array 260*a* and the second separation piece array 270*a* positioned juxtaposed with each other in the widthwise direction, density of the first separation pieces 260 can be increased. Further, because of the intimate arrangement of the first separation pieces 260, the number of first support portions 280 is also increased, which leads to further reinforcement to the inclined member 230.

Further, the plurality of reinforcing ribs 236 are provided on the back surface 232 of the inclined member 230 to surround at least a portion of edges of the openings (the slits 233). Because of the provision of the reinforcing ribs 236, the portion of the inclined member 230 defining the edges of the slits 233 can be reinforced by the reinforcing ribs 236, thereby attaining smooth movement of a sheet A and improvement of performance for separating the sheet A.

As illustrated in FIG. 11, the portion of the inclined member 230 forming the slits 233 has a dimension E in the normal direction C, and the first support portion 280 connected to the inclined member 230 has a dimension F in the inclined direction B. The dimension E is greater than the dimension F. With this configuration, since the inclined member 230 has a sufficient strength, the configuration of the inclined member 230 can be stabilized. Further, in a case where the first support portions 280 are integrally molded with the inclined member 230 with resin, formation of sink marks and deformation is unlikely to occur in the inclined member 230. Therefore, smooth movement of a sheet A along the inclined member 230 can be attained. Note that the second support portions 290 exhibit functions and effects the same as those of the first support portions 280 described above.

Each of the first separation pieces 260 has a dimension in the inclined direction B greater than that of each of the first support portions 280 in the inclined direction B, and each of the first separation pieces 260 has a dimension in the widthwise direction smaller than that of the first support portion 280 in the widthwise direction. In other words, the first separation piece 260 is in the form of relatively elongated and thick shape, and the first support portions 280 is in the form of relatively wide and thin shape.

With this configuration, since the first support portion 280 has a flexibility and is unlikely to be broken, the first separation piece 260 can be easily provided to be moved upward in the inclined direction B and toward the back surface 232 in the normal direction C. Further, since the first separation piece 260 is relatively thick, breakage of the first separation piece 260 due to direct application of load from a sheet A can be restrained. The second separation pieces 270 and the second support portions 290 exhibit functions and effects the same as those of the first separation pieces 260 and the first support portions 280 described above.

The plurality of first separation pieces 260 are arranged in the inclined direction B such that the first separation piece 260 moved diagonally upward and rearward is brought into abutment against the neighboring first separation piece 260. With this configuration, the first separation piece 260 on which the sheet A is abutted is moved diagonally upward and rearward. This movement of the first separation pieces 260 is then stopped by the abutment against the neighboring first separation piece 260 positioned upward of the moved first separation piece 260 in the inclined direction B.

Accordingly, the neighboring first separation piece 260 positioned upward of the moved first separation piece 260 functions as a stop member for stopping movement of the moved first separation piece 260. Hence, a movable range of the first separation piece 260 can be set within a suitable range. Accordingly, excessive movement of the first separation piece 260 in the inclined direction B that may cause breakage of the same can be effectively restrained. The second separation pieces 270 exhibit functions and effects the same as those of the first separation pieces 260 described above.

Each of the first separation piece 260 is supported by the corresponding one of the first support portions 280 such that the first separation piece 260 is movable away from the sheet placement surface 21*a* in the inclined direction B and toward the back surface 232 in the normal direction C of the inclined surface 231. Here, an amount of movement of the first distal end 262 away from the sheet placement surface 21*a* in the inclined direction B is greater than an amount of movement of the first distal end 262 toward the back surface 232 in the normal direction C.

With this configuration, the amount of rearward movement of the first separation piece 260 in the normal direction C is smaller than the amount of upward movement in the inclined direction B, a state where the first distal end 262 protrudes from the inclined surface 231 can be prolonged while the first separation piece 260 is depressed rearward due to the rearward movement thereof. Hence, a period of time during which the first separation piece 260 is in abutment against the leading edge of the sheet A can be made relatively long, and a load to be applied from the sheet A to the first separation piece 260 can be made small. The second separation pieces 270 exhibit functions and effects the same as those of the first separation pieces 260.

The first separation piece array 260*a* constituted by the first separation pieces 260 and the second separation piece array 270*a* constituted by the plurality of second separation pieces 270 are arranged in the widthwise direction (the left-right direction) such that the first separation piece array 260*a* is positioned at a center between the two second separation piece arrays 270*a*. The angle θ1 of the first separation piece 260 relative to the inclined direction B (the angle defined between the direction in which the first separation piece 260 protrudes and the inclined direction B) is greater than the angle θ2 of the second separation pieces 270 relative to the inclined direction B (the angle defined between the direction in which the second separation piece 270 protrudes and the inclined direction B).

Assuming that the inclined surface 231 is not a flat surface but a curved surface such that center portion in the width direction of the curved surface is positioned further frontward than end portions in the width direction of the curved surface, the leading edge of a thin sheet A moving along the inclined surface 231 is in abutment with both the first separation piece 260 and the second separation pieces 270, since the thin sheet A is flexed or bent along a curvature of the inclined surface 231. Therefore, a total load imparted on the thin sheet A from the separation pieces can be dispersed so that a load applied to each part in the sheet A can be made small, since the load is applied to the thin sheet A from the three separation piece arrays 260*a* and 270*a*. As a result, damage to the thin sheet A by the first and second separation pieces 260 and 270 can be reduced, and performance for separating the sheet A can be improved.

On the other hand, the leading edge of a thick sheet A moving along the inclined surface 231 is unlikely to abut against the second separation pieces 270 but more likely to abut against the first separation pieces 260 because the thick sheet A is unlikely to be bent. At this time, because the angle θ1 between the extending direction D1 of the first separation pieces 260 and the inclined direction B is greater than the angle θ2 between the extending direction D2 of the second separation pieces 270 and the inclined direction B, operation for separating the thick sheet A can be securely performed by the first separation pieces 260.

[Modification to Second Embodiment]

Next, a sheet feeding device according to a modification to the second embodiment will be described with reference to FIG. 12 wherein like parts and components are designated by the same reference numerals and characters as those shown in the above-described embodiments.

Figure 12:
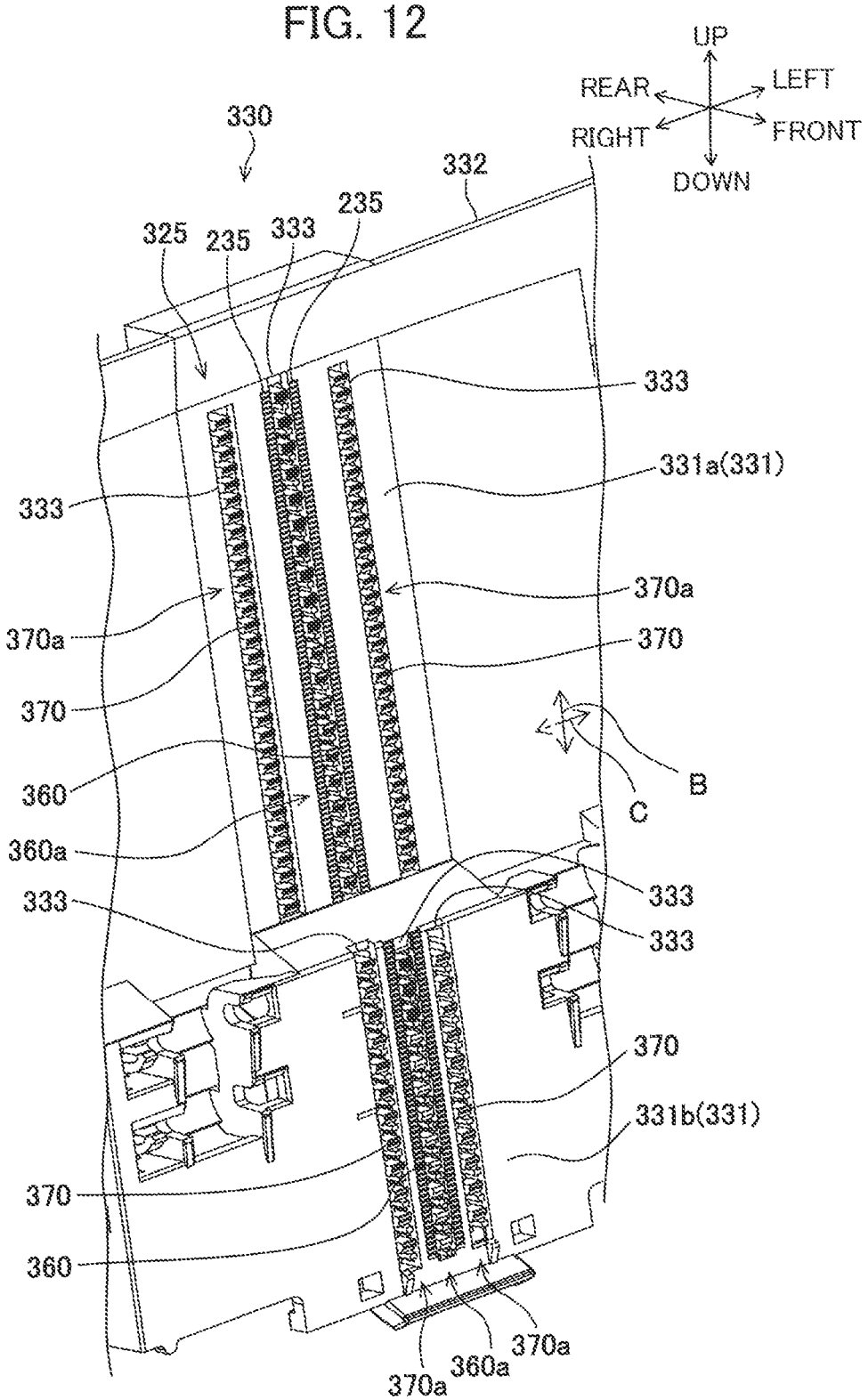
FIG. 12 is a partial enlarged perspective view of an inclined member and a sheet separating member in a sheet feeding device according to a modification to the second embodiment.

According to the modification illustrated in FIG. 12, at least three separation piece arrays are provided in the sheet feeding device. Specifically, one first separation piece array 360*a* and two second separation piece arrays 370*a* are arranged in the widthwise direction such that the first separation piece array 360*a* is positioned between the second separation piece arrays 370*a*. A gap between two neighboring first separation piece array 360*a* and the second separation piece array 370*a* is gradually or stepwisely increased as extending away from the sheet placement surface 21*a* in the incline direction B.

Specifically, an inclined surface 331 of an inclined member 330 of a sheet separating member 325 includes a plurality of inclined surfaces, i.e., an upper inclined surface 331*a* and a lower inclined surface 331*b* arranged in the inclined direction B. The upper inclined surface 331*a* and the lower inclined surface 331*b* extends in parallel to each other, i.e., in the inclined direction B. A stepped portion is provided between the upper inclined surface 331*a* and the lower inclined surface 331*b* such that the lower inclined surface 331*b* is positioned frontward of the upper inclined surface 331*a* in the normal direction C.

Each of the upper inclined surface 331*a* and the lower inclined surface 331*b* is formed with a plurality of slits 333 arranged in the left-right direction. Also, the first separation piece array 360*a* constituted by a plurality of first separation pieces 360 and the two second separation piece arrays 370*a* each constituted by a plurality of second separation pieces 370 are provided on each of the upper inclined surface 331*a* and the lower inclined surface 331*b*. In each of the upper inclined surface 331*a* and the lower inclined surface 331*b*, the plurality of slits 333 and the plurality of first and second separation piece arrays 360*a* and 370*a* are provided in one-to-one correspondence. Accordingly, three slits 333 is formed in each of the upper inclined surface 331*a* and the lower inclined surface 331*b*.

Each of the first separation piece array 360*a* and the second separation piece arrays 370*a* on the upper inclined surface 331*a* has a length in the inclined direction B greater than a length of each of the first separation piece array 360*a* and the second separation piece arrays 370*a* on the lower inclined surface 331*b*. Further, the first separation piece array 360*a* on the upper inclined surface 331*a* and the first separation piece array 360*a* on the lower inclined surface 331*b* are in alignment with each other in the left-right direction to extend in line in the inclined direction B.

A gap in the left-right direction between the neighboring first separation piece array 360*a* and second separation piece array 370*a* on the upper inclined surface 331*a* is greater than a gap in the left-right direction between the neighboring first separation piece array 360*a* and second separation piece array 370*a* on the lower inclined surface 331*b*. Accordingly, a gap in the left-right direction between the two second separation piece arrays 370*a* on the upper inclined surface 331*a* is greater than a gap in the left-right direction between the two second separation piece arrays 370*a* on the lower inclined surface 331*b*.

A sheet medium such as a postcard and calendered paper has a size smaller than and a thickness greater than those of plain papers. Normally, the smaller number of such thick sheet mediums are mounted on the sheet placement surface 21*a* compared to a case where the plain papers are mounted. Therefore, such sheet medium picked up by the pick-up roller 22*b* is likely to be brought into abutment with the lower inclined surface 331*b* at a lower position. Accordingly, the sheet medium is subjected to sheet separation by the first separation piece array 360*a* and the second separation piece arrays 370*a* on the lower inclined surface 331*b* on which these first and separation piece arrays 360*a* and 370*a* are provided intimately with each other in the left-right direction, whereby operation for separating the sheet medium can be efficiently performed.

In the meantime, a sheet A picked up by the pick-up roller 22*b* is more likely to be brought into abutment with an upper portion of the inclined surface 331 in proportion to an increase in the number of sheets A accommodated in the sheet accommodating unit 21. Therefore, the leading edge of the sheet A is brought into abutment against the first separation piece array 360*a* and the second separation piece array 370*a* on the upper inclined surface 331*a* those arranged with a wider interval in the left-right direction. Accordingly, a load applied to the sheet A from the first and second separation pieces 360 and 370 can be dispersed in the left-right direction.

On the other hand, in a case where the number of sheets A accommodated in the sheet accommodating unit 21 is fewer, a sheet A makes abutment against the first separation piece array 360*a* and the second separation piece arrays 370*a* on the lower inclined surface 331*b* and receives a load at a center portion in the left-right direction of the sheet A. In this way, a load imparted on the sheet A from the first and second separation pieces 360 and 370 can be changed in accordance with a size and a thickness of the sheet A, thereby further improving performance for separating the sheet A.

Note that the stepped portion may be dispensed with such that the upper inclined surface 331*a* and the lower inclined surface 331*b* are provided to be flush with each other on the same plane. Also, the upper inclined surface 331*a* and the lower inclined surface 331*b* may be configured so that one of these upper inclined surface 331*a* and the lower inclined surface 331*b* is a flat surface extending lineally in the left-right direction while the remaining one of the upper inclined surface 331*a* and the lower inclined surface 331*b* is a curved surface having a center portion in the left-right direction positioned further frontward than the remaining portion of the curved surface.

The number of first and second separation piece arrays 360*a* and 370*a* on the upper inclined surface 331*a* and the number of first and second separation piece arrays 360*a* and 370*a* on the lower inclined surface 331*b* are identical each other in the above modification. However, the number of these separation piece arrays on the upper inclined surface 331*a* and the lower inclined surface 331*b* may be different from each other, provided that the gap in the left-right direction between two second separation piece arrays 370*a* on the upper inclined surface 331*a* is greater than the gap in the left-right direction between the two second separation piece arrays 370*a* on the lower inclined surface 331*b*.

[Other Modifications and Variations]

Hereinafter, various modifications and variations to the embodiments and modifications thereof will be described with reference to FIGS. 13 to 15B, wherein like parts and components are designated by same reference numerals and characters as shown in the above embodiments to avoid duplicating description.

Figure 7:
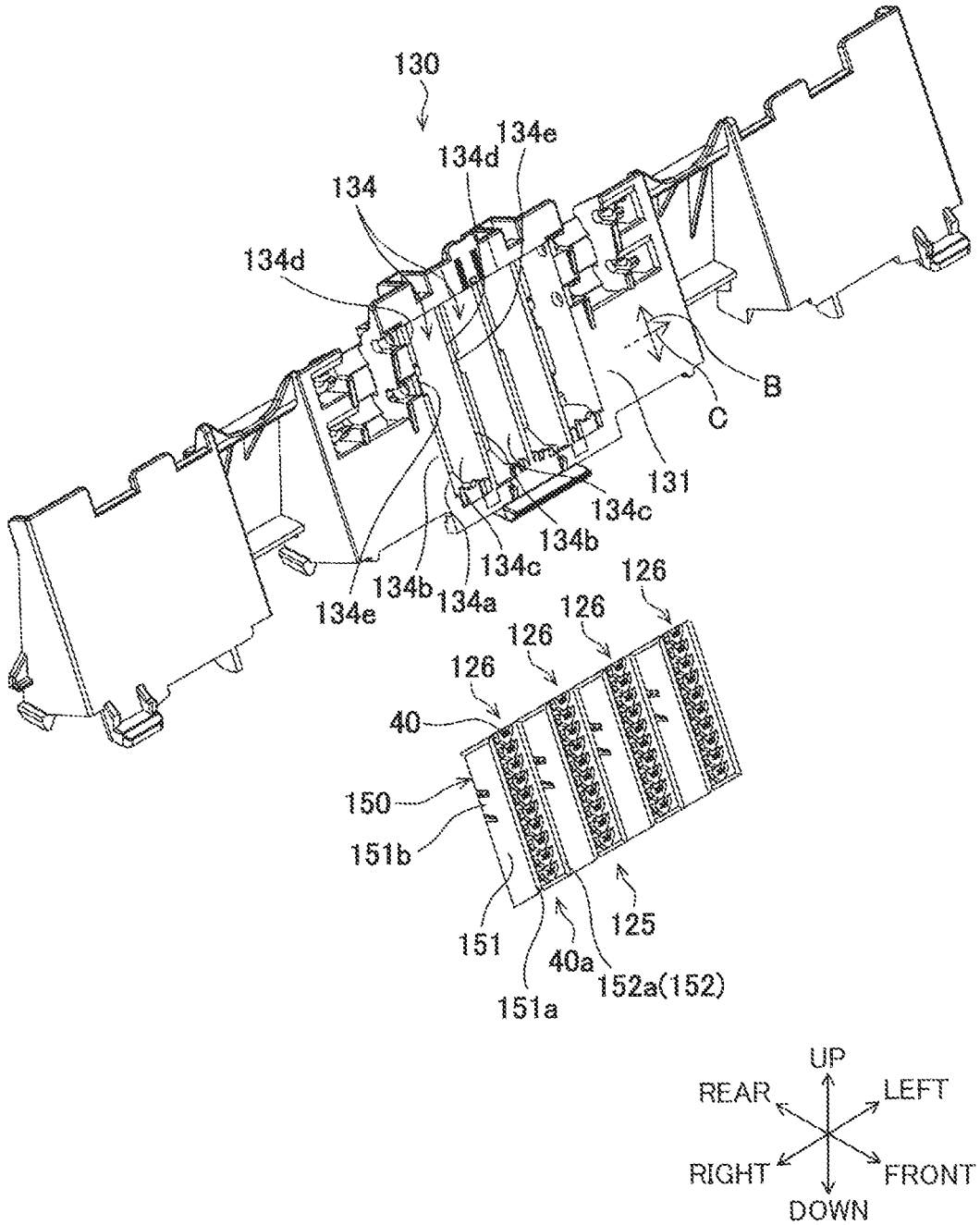
FIG. 7 is a perspective view of an inclined member and a sheet separating member detached therefrom in a sheet feeding device according to a modification to the first embodiment.
Figure 8:
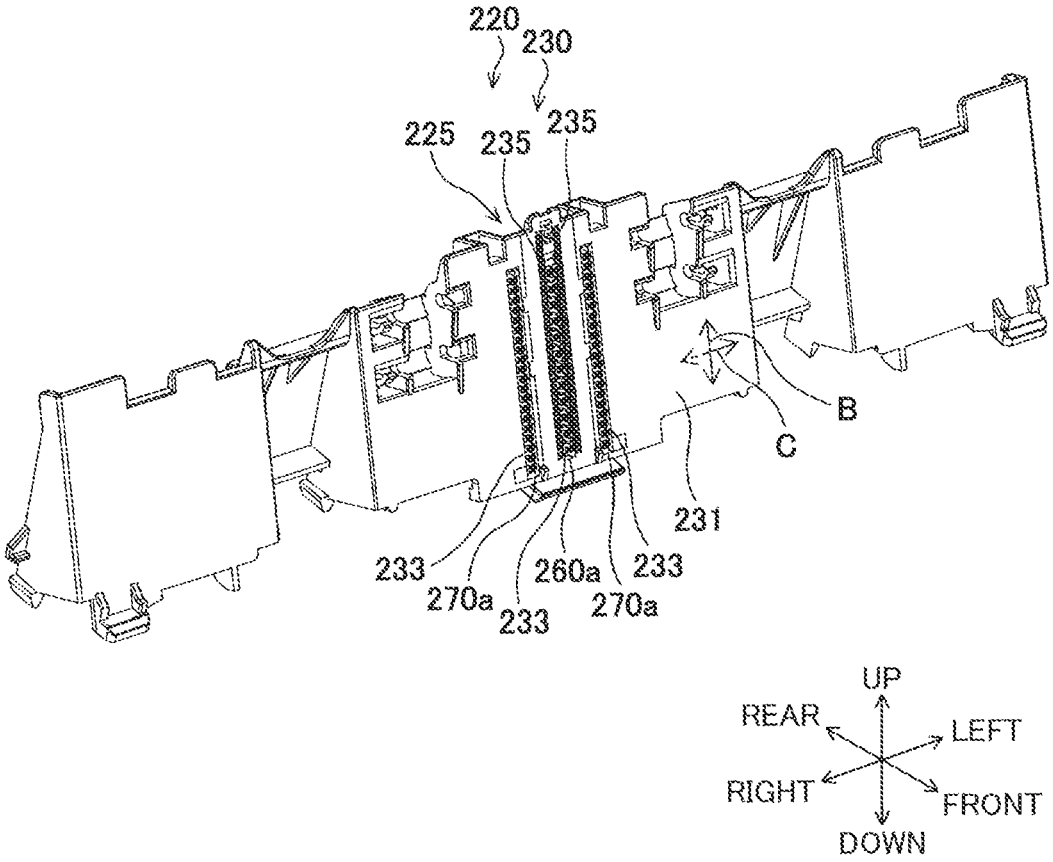
FIG. 8 is a perspective view of an inclined member and a sheet separating member in a sheet feeding device according to a second embodiment of the present disclosure as viewed from a front side thereof.
Figure 13:
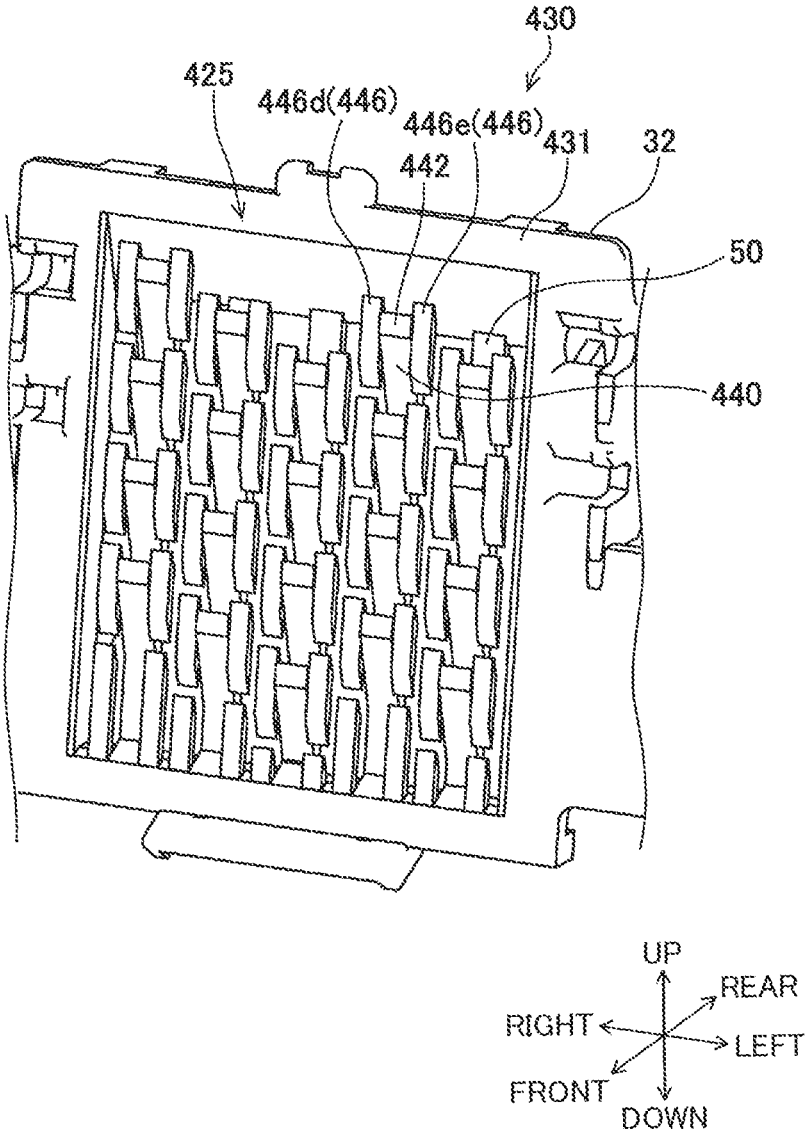
FIG. 13 is a partial enlarged perspective view of an inclined member and a sheet separating member in a sheet feeding device according to another modification to the first embodiment.

FIG. 13 illustrates another modification to the first embodiment and the modification to the first embodiment (FIG. 7). According to the first embodiment and the modification thereto, the plurality of the auxiliary inclined surfaces 46 having a substantially U-shape is provided to surround the distal end 42 of corresponding one of the separation pieces 40. However, the shape of the auxiliary inclined surfaces 46 is not limited thereto. For example, as illustrated in FIG. 13, each of a plurality of separation pieces 440 has an auxiliary inclined surface 446 includes a right surface 446*d* and a left surface 446*e*. The right surface 446*d* is positioned rightward of a distal end 442 of the corresponding one of the separation pieces 440, whereas the left surface 446*e* is positioned leftward of the distal end 442 of the corresponding one of the separation pieces 440.

The right surface 446*d* and the left surface 446*e* extends in the inclined direction B to further protrude outward (upward and downward) in the inclined direction B than the distal end 442 of the corresponding separation piece 440, and includes an upper region positioned upward of the distal end 442 and a lower region positioned downward of the distal end 442. Accordingly, a combination of the distal end 442, the right surface 446*d*, and the left surface 446*e* of the separation piece 440 forms a substantially H-shape. With this configuration, a sheet A moving on an inclined surface 431 is brought into abutment against the right surface 446*d* and the left surface 446*e* prior to abutment against the distal end 442 of the separation piece 440. Therefore, the sheet A can be prevented from entering a gap between neighboring separation pieces 440, thereby reducing occurrence of a sheet jam.

According to the first embodiment and the modification to the first embodiment, the distal end 42 of each of the separation pieces 40 is constituted by the two protrusions 44. However, the number of protrusions 44 need not be two, and the distal end 42 may be constituted by one or more than three protrusions. Similarly, the first distal end 262 of the first separation piece 260 and the second distal end 272 of the second separation piece 270 according to the second embodiment and the modification to the second embodiment (see FIG. 12) may have a plurality of protrusions.

For example, FIGS. 14A to 14D illustrate variations to the above embodiments in which the number and the shape of the protrusions 44 are modified. According to the variation in FIG. 14A, a distal end 542 of each of separation pieces 540 is constituted by three protrusions 544 extending in parallel to one another in the left-right direction and arranged in the inclined direction B. That is, two slit portions 543*a* and 543*b* extending in the left-right direction are formed in the distal end 542 at a position spaced apart from each other to divide the distal end 542 into the three protrusions 544. In other words, the protrusion 544 positioned at a center portion in the inclined direction B is positioned between the two slit portions 543*a* and 543*b*, an upper protrusion 544 is positioned above the upper slit portion 543*b*, and a lower protrusion 544 is positioned below the lower slit portion 543*a*.

This configuration in which the number of protrusions is increased is particularly effective for increasing the number of times of abutment of a sheet A moving along an inclined surface 531 against the three protrusions 544. Therefore, performance for separating the sheet A can further be improved.

Further, according to the first embodiment and the modification (FIG. 7) to the first embodiment, the two protrusions 44 have shape identical to each other. However, the shape of the protrusions need not be limited thereto.

Figure 14A:
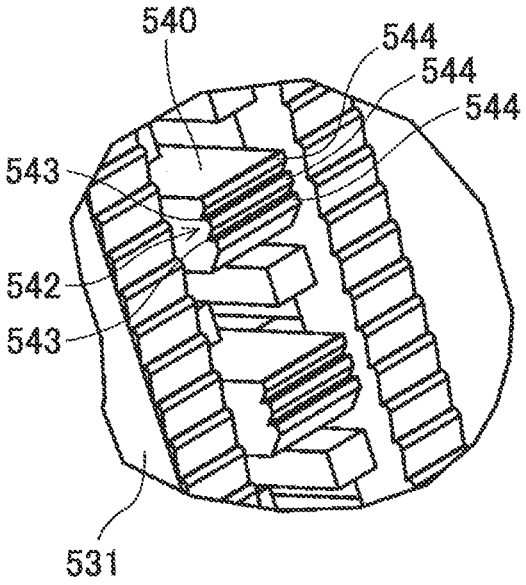
FIG. 14A through 14D are partial enlarged perspective views of inclined members and sheet separating members in sheet feeding devices according to variations to the first and second embodiment.
Figure 14B:
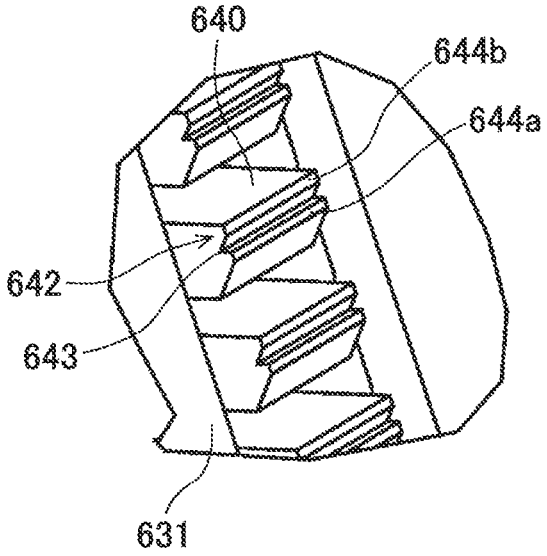

For example, FIG. 14B illustrates a variation in which a plurality of separation pieces 640 includes a distal end 642. The distal end 642 is formed with a slit portion 643 extending in the left-right direction to form two protrusions 644*a* and 644*b* arranged in the inclined direction B. The lower protrusion 644*a* has a dimension in the inclined direction B greater than that of an upper protrusion 644*b*.

With this configuration, a sheet A moving on an inclined surface 631 is likely to make abutment against the lower protrusion 644*a* positioned upstream of the upper protrusion 644*b* in the sheet feeding direction, whereby the sheet A can be easily separated from the stack of sheets A. Further, when a sheet A to be separated from the uppermost sheet A is moved accompanying the upper most sheet A on the inclined surface 631, the accompanying sheet A can be separated at the upper protrusion 644*b* positioned downstream of the lower protrusion 644*a*. That is, an opportunity for separating of the uppermost sheet A can be increased, thereby enhancing for separating the sheet A.

Figure 14C:
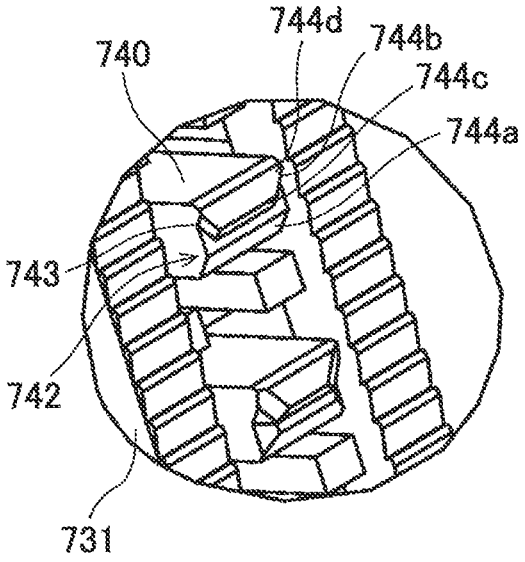

Further, according to a variation in FIG. 14C, each of separation pieces 740 includes a distal end 742 constituted by two protrusions 744*a* and 744*b* defined by a slit portion 743. Of the two protrusions 744*a* and 744*b*, the lower protrusion 744*a* has a dimension in the left-right direction greater than that of the upper protrusion 744*b*.

With this configuration, a sheet A moving along an inclined surface 731 is likely to abut against the lower protrusion 744*a* positioned upstream of the upper protrusion 744*b* in the sheet feeding direction, thereby realizing efficient operation for separating the sheet A. Hence, since the upper protrusion 744*b* is also provided, an opportunity of separation of the sheet A can be increased. Further, since an area of the upper protrusion 744*b* for contacting a sheet A is small, the separated sheet A can be smoothly moved along the inclined surface 731.

Further, as illustrated in FIG. 14C, the upper protrusion 744*b* is tapered such that the dimension in the left-right direction is gradually reduced as extending frontward. The upper protrusion 744*b* has an upper trapezoidal surface 744*d* and a lower trapezoidal surface 744*c* whose area is smaller than that of the upper trapezoidal surface 744*d*. With this configuration, pivotal movement of the separation piece 740 due to the abutment of the leading edge of the sheet A against the lower surface 744*c* takes a relatively long time, and the sheet A separated at the lower protrusion 744*a* can be easily moved past the upper protrusion 744*b*. Hence, occurrence of a sheet jam can be restrained.

Figure 14D:
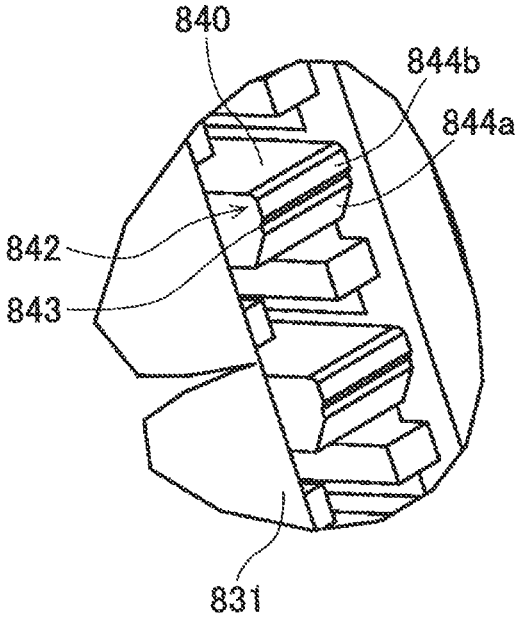

FIG. 14D illustrate a variation in which each of separation pieces 840 includes a distal end 842, which is constituted by two protrusions 844*a* and 844*b* arranged in the inclined direction B. The distal end 842 is formed with a slit portion 843 to separate the distal end 842 into the two protrusions 844*a* and 844*b*. According to the variation in FIG. 14D, the lower protrusion 844*a* has a dimension in the extending direction D greater than that of the upper protrusion 844*b*.

With this configuration, a sheet A moving along an inclined surface 831 is likely to abut against the lower protrusion 844*a* positioned upstream of the upper protrusion 844*b* in the sheet feeding direction, thereby facilitating separation of the sheet A. Further, the sheet A separated at the lower protrusion 844*a* can be easily moved past the upper protrusion 844*b*.

Further, in the embodiments and modifications described above, the protrusions 44 may have a curved shape by performing round chamfering. In this case, the protrusions 44 has a curved surface curved with respect to the inclined direction B, thereby suppressing damage to a sheet A occurred due to a corner of the protrusions 44.

Figure 15A:
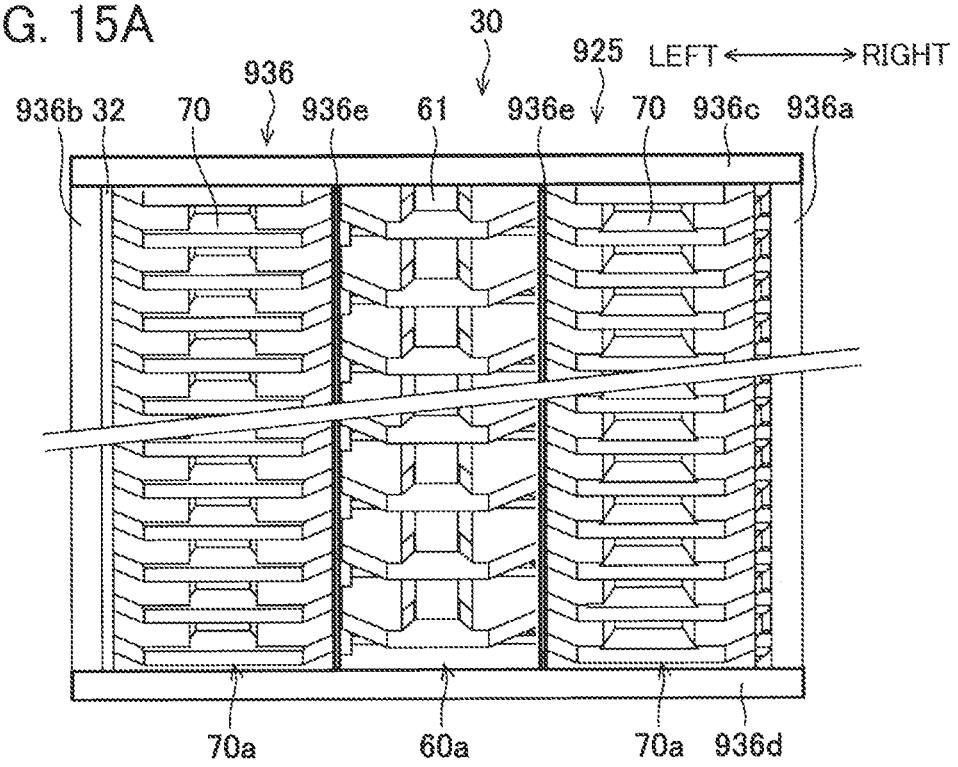
FIGS. 15A and 15B are enlarged perspective views of inclined members and sheet separating members in sheet feeding devices according to other modifications to the second embodiment.

FIG. 15A illustrates a first variation to the second embodiment and the modifications thereof. In this variation, a sheet separating member 925 is provided with a plurality of reinforcing ribs 936 including two reinforcing ribs 936*e* each extending in the inclined direction B in addition to a right reinforcing rib 936*a*, a left reinforcing rib 936*b*, an upper reinforcing rib 936*c*, and a lower reinforcing rib 936*d*.

The two reinforcing ribs 936*e* are positioned between the right reinforcing rib 936*a* and the left reinforcing rib 936*b* in the left-right direction. Specifically, one of the reinforcing ribs 936*e* is positioned between the first separation piece array 260*a* and one of the second separation piece arrays 270*a* in the left-right direction, and the remaining one of the reinforcing ribs 936*e* is positioned between the first separation piece array 260*a* and the remaining one of the second separation piece arrays 270*a* in the left-right direction.

Figure 15B:
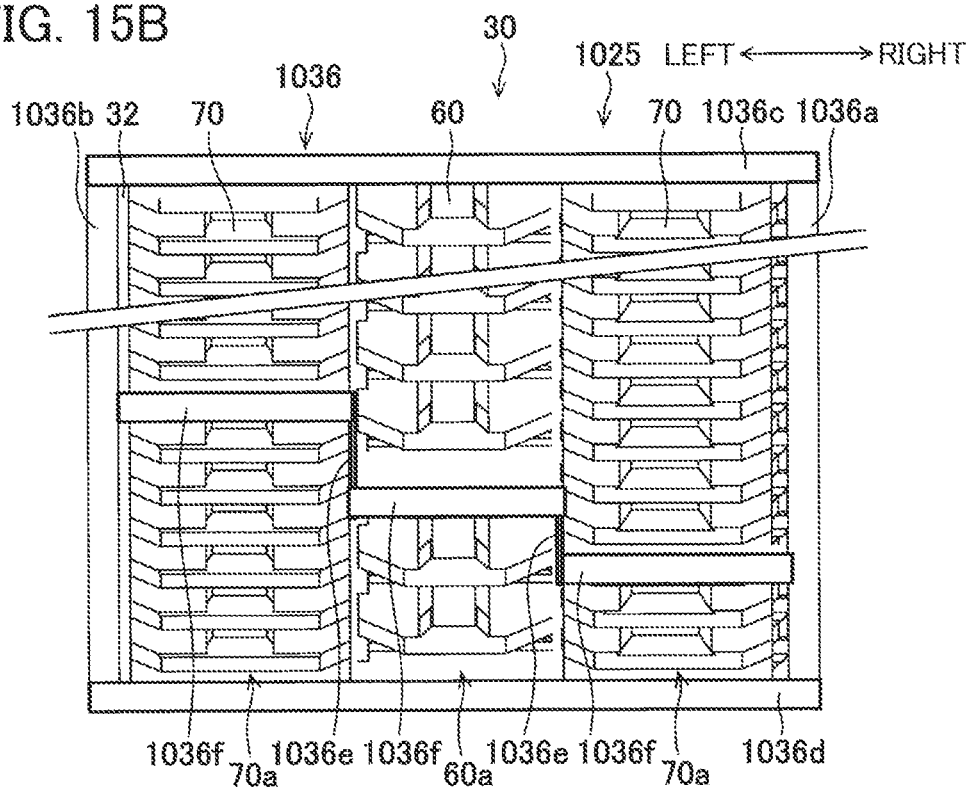

Further, FIG. 15B illustrates a second variation to the second embodiment and the modifications thereof. In this variation, a sheet separating member 1025 includes a plurality of reinforcing ribs 1036 including a plurality of reinforcing ribs 1036*e* extending in the inclined direction B and a plurality of reinforcing ribs 1036*f* extending in the left-right direction, in addition to a right reinforcing rib 1036*a*, a left reinforcing rib 1036*b*, an upper reinforcing rib 1036*c*, and a lower reinforcing rib 1036*d*.

Each of the plurality of reinforcing ribs 1036*e* are positioned between neighboring first separation piece arrays 260 or neighboring second separation piece array 270 in the inclined direction B of the corresponding one of the separation piece arrays. Also, the plurality of reinforcing ribs 1036*f* are connected to each other by one of the reinforcing ribs 1036*e* to constitute a step-like shape as viewed in the front-rear direction.

The various embodiments and the modifications those are described above may be suitably combined together as long as conflicting combination is avoided. The various improvements of the present disclosure and other embodiments thereof would be apparent to those skilled in the art by virtue of the above description. Accordingly, the above description is intended to disclose better embodiment for implementing the present disclosure to those skilled in the art and should be interpreted as merely examples of the present disclosure. The configurations and/or the functions disclosed in the above description can be suitably modified without departing the scope of the present disclosure.

REMARKS

The sheet accommodating unit 21 is an example of an accommodating unit. The sheet placement surface 21*a* is an example of a placement surface. The inclined direction B is an example of an inclined direction. The normal direction C is an example of a normal direction of an inclined surface. The left-right direction is an example of a widthwise direction. The plurality of separation pieces 40, the plurality of first separation pieces 270, and the plurality of second separation pieces 280 are examples of a plurality of separation pieces. The support portions 50 and 150, the plurality of first support portions 280, and the plurality of second support portions 290 are examples of a support portion. The support portions 50 and 150, the plurality of first support portions 280, and the plurality of second support portions 290 are also examples of at least one support portion. The plurality of first support portions 280, and the plurality of second support portions 290 are also examples of a plurality of support portion. The groove portion 54 is an example of a recessed portion. Portions of the inclined member 30 above a portion at which the inclined member 30 and each of the plurality of separation pieces 40 are connected to each other in the inclined direction B is one example a plurality of first portions. Portions of the inclined member 30 below the portion at which the inclined member 30 and each of the plurality of separation pieces 40 are connected to each other in the inclined direction B is one example of a plurality of second portions. The right wall 151 and the left wall 152 are an example of a pair of wall portions. The plurality of slits 33, 233, and 333, and the plurality of openings 134*a* are examples of a plurality of openings. The plurality of separation piece arrays 40*a*, the plurality of first separation piece arrays 270*a* and 370*a*, and the plurality of second separation piece arrays 280*a* and 380*a* are examples of a plurality of separation piece arrays. The plurality of second separation piece arrays 370*a* are examples of a first separation piece array and a second separation piece array.

What is claimed is:

1. A sheet feeding device comprising:

an accommodating unit for accommodating therein a stack of a plurality of sheets, the accommodating unit having a placement surface on which the stack of a plurality of sheets is to be mounted;

an inclined member having an inclined surface and a back surface opposite the inclined surface, the inclined surface being inclined relative to the placement surface to extend in an inclined direction;

a sheet pick-up unit for feeding an uppermost sheet in the stack of a plurality of sheets on the placement surface toward the inclined member; and a sheet separating member provided on the inclined surface, the sheet separating member comprising:

a plurality of separation pieces, each of the plurality of separation pieces being made of resin and having a distal end protruding from the inclined surface and a base end; and a support portion made of resin and supporting the base end of each of the plurality of separation pieces at a position closer to the back surface than to the inclined surface, wherein the plurality of separation pieces are supported by the support portion so that the plurality of separation pieces are movable in a direction away from the placement surface in the inclined direction and in a direction toward the back surface in a normal direction of the inclined surface independently from one another, and wherein an amount of movement of the distal end of each of the plurality of separation pieces in the direction away from the placement surface in the inclined direction is greater than an amount of movement of the distal end of each of the plurality of separation pieces in the direction toward the back surface in the normal direction.

2. The sheet feeding device according to claim 1, wherein each of the plurality of separation pieces is inclined relative to the normal direction such that the distal end of each of the plurality of separation pieces is positioned farther away from the placement surface than the base end of the corresponding one of the plurality of separation pieces is from the placement surface in the inclined direction.

3. A sheet feeding device comprising:

an accommodating unit for accommodating therein a stack of a plurality of sheets, the accommodating unit having a placement surface on which the stack of a plurality of sheets is to be mounted;

an inclined member having an inclined surface and a back surface opposite the inclined surface, the inclined surface being inclined relative to the placement surface to extend in an inclined direction;

a sheet pick-up unit for feeding an uppermost sheet in the stack of a plurality of sheets on the placement surface toward the inclined member; and a sheet separating member provided on the inclined surface, the sheet separating member comprising:

a plurality of separation pieces, each of the plurality of separation pieces being made of resin and having a distal end protruding from the inclined surface and a base end; and a support portion made of resin and supporting the base end of each of the plurality of separation pieces at a position closer to the back surface than to the inclined surface, wherein the plurality of separation pieces are supported by the support portion so that the plurality of separation pieces are movable in a direction away from the placement surface in the inclined direction and in a direction toward the back surface in a normal direction of the inclined surface independently from one another, and wherein the support portion is formed with a recessed portion recessed from the inclined surface toward the back surface to have a bottom surface, each of the plurality of separation pieces and the support portion are formed integrally with each other so that each of the plurality of separation pieces upstands from the bottom surface of the recessed portion.

4. The sheet feeding device according to claim 3, wherein the bottom surface of the recessed portion, from which each separation piece upstands, is formed with a through-hole at at least one of a pair of opposite sides of the base end of each separation piece in the inclined direction.

5. A sheet feeding device comprising:

an accommodating unit for accommodating therein a stack of a plurality of sheets, the accommodating unit having a placement surface on which the stack of a plurality of sheets is to be mounted;

an inclined member having an inclined surface and a back surface opposite the inclined surface, the inclined surface being inclined relative to the placement surface to extend in an inclined direction;

a sheet pick-up unit for feeding an uppermost sheet in the stack of a plurality of sheets on the placement surface toward the inclined member; and a sheet separating member provided on the inclined surface, the sheet separating member comprising:

a plurality of separation pieces, each of the plurality of separation pieces being made of resin and having a distal end protruding from the inclined surface and a base end; and a support portion made of resin and supporting the base end of each of the plurality of separation pieces at a position closer to the back surface than to the inclined surface, wherein the plurality of separation pieces are supported by the support portion so that the plurality of separation pieces are movable in a direction away from the placement surface in the inclined direction and in a direction toward the back surface in a normal direction of the inclined surface independently from one another, wherein the sheet separating member comprises a separation piece unit detachably attachable to the inclined member, the separation piece unit comprises:

a separation piece array constituted by the plurality of separation pieces arranged in line in the inclined direction; and a pair of wall portions extending in the inclined direction and formed integrally with the separation piece array, the separation piece array being positioned between the pair of wall portions, and wherein, in a state where the separation piece unit is attached to the inclined member, a front surface of each of the pair of wall portions is flush with the inclined surface.

6. A sheet feeding device comprising:

an accommodating unit for accommodating therein a stack of a plurality of sheets, the accommodating unit having a placement surface on which the stack of a plurality of sheets is to be mounted;

an inclined member having an inclined surface and a back surface opposite the inclined surface, the inclined surface being inclined relative to the placement surface to extend in an inclined direction;

a sheet pick-up unit for feeding an uppermost sheet in the stack of a plurality of sheets on the placement surface toward the inclined member; and a sheet separating member provided on the inclined surface, the sheet separating member comprising:

a plurality of separation pieces, each of the plurality of separation pieces being made of resin and having a distal end protruding from the inclined surface and a base end; and a support portion made of resin and supporting the base end of each of the plurality of separation pieces at a position closer to the back surface than to the inclined surface, wherein the plurality of separation pieces are supported by the support portion so that the plurality of separation pieces are movable in a direction away from the placement surface in the inclined direction and in a direction toward the back surface in a normal direction of the inclined surface independently from one another, wherein the sheet feeding device further comprises a plurality of auxiliary inclined surfaces positioned further outward than the distal end of the corresponding one of the plurality of separation pieces in a widthwise direction perpendicular to the inclined direction and the normal direction, the plurality of auxiliary inclined surfaces being positioned closer to the back surface than the distal end of the corresponding one of the plurality of separation pieces is to the back surface, and wherein the support portion movably supports the distal end of each of the plurality of separation pieces and each of the plurality of auxiliary inclined surfaces.

7. The sheet feeding device according to claim 6, wherein the plurality of auxiliary inclined surfaces are provided to be flush with the inclined surface.

8. The sheet feeding device according to claim 6, wherein each of the plurality of auxiliary inclined surfaces has a portion positioned closer to the placement surface than the distal end of the corresponding one of the plurality of separation pieces is to the placement surface in the inclined direction, and wherein each of the plurality of separation pieces has a sheet guide surface positioned closer to the placement surface than the corresponding one of the plurality of auxiliary inclined surfaces is to the placement surface in the inclined direction, the sheet guide surface being inclined relative to the corresponding one of the plurality of auxiliary inclined surfaces toward the back surface as extending toward the placement surface.

9. The sheet feeding device according to claim 6, wherein each of the plurality of auxiliary inclined surfaces has a portion extending farther away from the placement surface than the distal end of the corresponding one of the plurality of separation pieces in the inclined direction.

10. The sheet feeding device according to claim 6, wherein a dimension in the widthwise direction of each of the plurality of separation pieces excluding the distal end is equal to a dimension in the widthwise direction of the corresponding one of the plurality of auxiliary inclined surfaces.

11. A sheet feeding device comprising:

an accommodating unit for accommodating therein a stack of a plurality of sheets, the accommodating unit having a placement surface on which the stack of a plurality of sheets is to be mounted;

an inclined member having an inclined surface and a back surface opposite the inclined surface, the inclined surface being inclined relative to the placement surface to extend in an inclined direction;

a sheet pick-up unit for feeding an uppermost sheet in the stack of a plurality of sheets on the placement surface toward the inclined member; and a sheet separating member provided on the inclined surface, the sheet separating member comprising:

a plurality of separation pieces, each of the plurality of separation pieces being made of resin and having a distal end protruding from the inclined surface and a base end; and a support portion made of resin and supporting the base end of each of the plurality of separation pieces at a position closer to the back surface than to the inclined surface, wherein the plurality of separation pieces are supported by the support portion so that the plurality of separation pieces are movable in a direction away from the placement surface in the inclined direction and in a direction toward the back surface in a normal direction of the inclined surface independently from one another, and wherein the distal end of each of the plurality of separation pieces is constituted by a plurality of protrusions arranged in the inclined direction.

12. A sheet feeding device comprising:

an accommodating unit for accommodating therein a stack of a plurality of sheets, the accommodating unit having a placement surface on which the stack of a plurality of sheets is to be mounted;

an inclined member having an inclined surface and a back surface opposite the inclined surface, the inclined surface being inclined relative to the placement surface to extend in an inclined direction;

a sheet pick-up unit for feeding an uppermost sheet in the stack of a plurality of sheets on the placement surface toward the inclined member; and a sheet separating member provided on the inclined surface, the sheet separating member comprising:

a plurality of separation pieces, each of the plurality of separation pieces being made of resin and having a distal end protruding from the inclined surface and a base end; and a support portion made of resin and supporting the base end of each of the plurality of separation pieces at a position closer to the back surface than to the inclined surface, wherein the plurality of separation pieces are supported by the support portion so that the plurality of separation pieces are movable in a direction away from the placement surface in the inclined direction and in a direction toward the back surface in a normal direction of the inclined surface independently from one another, wherein the plurality of separation pieces are arranged in line in the inclined direction, and wherein the inclined surface is formed with an opening, the opening being elongated in the inclined direction, the opening allowing the plurality of separation pieces to protrude therethrough such that the base end of each separation piece is disposed at a position further away from the inclined surface than the back surface is from the inclined surface and the distal end of each separation piece is disposed further away from the back surface than the inclined surface is from the back surface.

13. A sheet feeding device comprising:

an accommodating unit for accommodating therein a stack of a plurality of sheets, the accommodating unit having a placement surface on which the stack of a plurality of sheets is to be mounted;

an inclined member having an inclined surface and a back surface opposite the inclined surface, the inclined surface being inclined relative to the placement surface to extend in an inclined direction;

a sheet pick-up unit for feeding an uppermost sheet in the stack of a plurality of sheets on the placement surface toward the inclined member; and a sheet separating member provided on the inclined surface, the sheet separating member comprising:

a plurality of separation pieces, each of the plurality of separation pieces being made of resin and having a distal end protruding from the inclined surface and a base end; and at least one support portion made of resin and supporting the base end of each of the plurality of separation pieces at a position closer to the back surface than to the inclined surface, wherein the inclined surface is formed with a plurality of openings arranged in a widthwise direction perpendicular to the inclined direction, each of the plurality of openings allowing at least one of the plurality of separation pieces to protrude therethrough, and wherein the at least one support portion is connected to portions of the inclined member defining both edges in the widthwise direction of each of the plurality of openings at the back surface so that the at least one support portion is bridged over each of the plurality of openings in the widthwise direction.

14. The sheet feeding device according to claim 13, wherein the at least one support portion includes a plurality of support portions, each of the plurality of support portions supporting a corresponding one of the plurality of separation pieces, wherein the sheet separating member comprises a plurality of separation piece arrays arranged in parallel to one another in the widthwise direction, each of the plurality of separation piece arrays being constituted by at least one of the plurality of separation pieces arranged in line in the inclined direction, and wherein, in the neighboring two separation piece arrays of the plurality of separation piece arrays, the plurality of support portions are alternately arranged in the inclined direction to be displaced from each other in the inclined direction.

15. The sheet feeding device according to claim 14, wherein the plurality of separation piece arrays comprises at least three separation piece arrays comprising a first separation piece array, a second separation piece array, and a third separation piece array arranged in the widthwise direction, the first separation piece array being positioned between the second separation piece array and the third separation piece array in the widthwise direction, and wherein a gap in the widthwise direction between the first separation piece array and the third separation piece array, and a gap in the widthwise direction between the second separation piece array and the third separation piece array are stepwisely or gradually increased as extending away from the placement surface in the inclined direction.

16. The sheet feeding device according to claim 13, further comprising a reinforcing rib provided at the back surface, the reinforcing rib upstanding to surround at least a portion of edges of each of the plurality of openings.

17. The sheet feeding device according to claim 13, wherein the portion of the inclined member defining both edges in the widthwise direction of each of the plurality of openings has a dimension in a normal direction of the inclined surface greater than a dimension in the inclined direction of the at least one support portion connected to the inclined member.

18. The sheet feeding device according to claim 13, wherein each of the plurality of separation pieces has a dimension in the inclined direction greater than a dimension in the inclined direction of the at least one support portion, and wherein each of the plurality of separation pieces has a dimension in the widthwise direction smaller than a dimension in the widthwise direction of the at least one support portion.

19. The sheet feeding device according to claim 13, wherein the plurality of separation pieces are arranged in the inclined direction and include a first separation piece and a second separation piece positioned juxtaposed to each other in the inclined direction, and wherein the first separation piece is brought into abutment against the second separation piece when the first separation piece is moved in the inclined direction.

20. The sheet feeding device according to claim 13, wherein each of the plurality of separation pieces is supported by the at least one support portion such that each of the plurality of separation pieces is movable in a direction away from the placement surface in the inclined direction and in a direction toward the back surface in a normal direction of the inclined surface, and wherein an amount of movement of each of the plurality of separation pieces in the direction away from the placement surface in the inclined direction is greater than an amount of movement of each of the plurality of separation pieces in the direction toward the back surface in the normal direction.

21. The sheet feeding device according to claim 13, wherein the plurality of separation pieces comprises one first separation piece and two second separation pieces, the one first separation piece being positioned between the two second separation pieces in the widthwise direction, and wherein an angle between a direction in which the one first separation piece protrudes and the inclined surface is greater than an angle between a direction in which each of the two second separation pieces protrudes and the inclined surface.

* * * * *